US011448477B2

(12) United States Patent
Foster

(10) Patent No.: US 11,448,477 B2
(45) Date of Patent: Sep. 20, 2022

(54) MULTI-MODE FIREARMS, TRIGGERS, KITS, AND METHODS OF USE

(71) Applicant: David Foster, Seymour, IN (US)

(72) Inventor: David Foster, Seymour, IN (US)

(73) Assignee: FOSTECH, INC., Seymour, IN (US)

( * ) Notice: Subject to any disclaimer, the term of this patent is extended or adjusted under 35 U.S.C. 154(b) by 0 days.

(21) Appl. No.: 16/747,343

(22) Filed: Jan. 20, 2020

(65) Prior Publication Data

US 2020/0191513 A1 Jun. 18, 2020

Related U.S. Application Data

(63) Continuation-in-part of application No. 16/278,985, filed on Feb. 19, 2019, now Pat. No. 10,584,932, which is a continuation-in-part of application No. 15/466,023, filed on Mar. 22, 2017, now Pat. No. 10,267,585, which is a continuation-in-part of application No. 15/419,460, filed on Jan. 30, 2017, now Pat. No. 10,254,067.

(60) Provisional application No. 62/961,850, filed on Jan. 16, 2020, provisional application No. 62/794,672, filed on Jan. 20, 2019, provisional application No. 62/632,014, filed on Feb. 19, 2018, provisional application No. 62/311,807, filed on Mar. 22, 2016, provisional application No. 62/288,385, filed on Jan. 28, 2016.

(51) Int. Cl.
*F41A 19/16* (2006.01)

(52) U.S. Cl.
CPC ..... *F41A 19/16* (2013.01)

(58) Field of Classification Search
CPC ..... F41A 19/10; F41A 19/16; F41A 19/24
See application file for complete search history.

(56) References Cited

U.S. PATENT DOCUMENTS 6,966,138 B1 * 11/2005 Deckard ..... F41A 19/24 42/69.01
8,667,881 B1 * 3/2014 Hawbaker ..... F41A 19/46 89/139
9,146,066 B1 * 9/2015 Cason ..... F41A 19/09
9,952,012 B2 * 4/2018 Fellows ..... F41A 19/14
(Continued)

FOREIGN PATENT DOCUMENTS

WO WO-2008087234 A1 * 7/2008 ..... F41A 19/02

*Primary Examiner* — Joshua T Semick
(74) *Attorney, Agent, or Firm* — Eric B. Fugett; Mark A. Pitchford; Pitchford Fugett, PLLC

(57) ABSTRACT

Provided are multi-mode firearms, triggers, kits, and methods of use that allow a user to select between a semi-automatic firing mode and a pull-and-release firing mode that fires the firearm upon both pulling the trigger and releasing the trigger, by using the selector switch or other mechanism to change the amount the trigger can move. A safe mode that prevents the firearm from firing may also be selected in various example embodiments by using the selector switch or other mechanism to change the amount the trigger can move. In certain example embodiments the trigger cannot move at all in safe mode, can move more in semi-automatic mode, and can move yet more in pull-and-release mode. The modes can be positioned for selection in any order. Kits comprising a trigger assembly and a selector assembly are provided for retrofitting conventional semi-automatic firearms.

15 Claims, 27 Drawing Sheets

(56) References Cited

U.S. PATENT DOCUMENTS

| | | | | |
|---|---|---|---|---|
| 9,952,013 | B2 * | 4/2018 | Fellows | F41A 19/10 |
| 10,337,818 | B1 * | 7/2019 | Sampson, Jr. | F41A 19/12 |
| 10,480,882 | B2 * | 11/2019 | Fellows | F41A 19/43 |

* cited by examiner

MULTI-MODE FIREARMS, TRIGGERS, KITS, AND METHODS OF USE

CROSS-REFERENCE TO RELATED APPLICATIONS

This application claims priority to, incorporates herein by reference, and is a non-provisional of U.S. provisional patent application No. 62/961,850 to David Foster, filed Jan. 16, 2020 and entitled Trigger with Pull and Release Mode, Semi-Auto Mode, Safe Mode, and Mode Selection by Control of Trigger Travel (herein "the '850 Application").

This application further claims priority to, incorporates herein by reference, and is a continuation-in-part of co-pending U.S. regular utility patent application Ser. No. 16/278,985 to David Foster, filed Feb. 19, 2019 and entitled Trigger-Locking Apparatus, System, and Method for Semi-automatic Firearms, published as US 2019-0186858 A1 on Jun. 20, 2019 (herein "the '985 Application").

This application additionally claims priority to and incorporates herein by reference the US provisional patent applications to which the '985 Application claims priority and incorporates by reference, including U.S. provisional patent application No. 62/794,672 to David Foster, filed Jan. 20, 2019 and entitled AK Backup Disconnect Application AND Timing Lever-Trigger Lock Additional Embodiments AND Assisted Trigger Reset Application (herein "the '672 Application"), and U.S. provisional patent application No. 62/632,014 to David Foster, filed Feb. 19, 2018 and entitled Systems, Methods, and Kits for Preventing Bump Fire (herein "the '014 Application").

This application still further claims priority to, incorporates herein by reference, and is a continuation-in-part of U.S. regular utility patent application Ser. No. 15/466,023 to David Foster, filed Mar. 22, 2017 and entitled Trigger Having a Movable Sear and Firearms Incorporating Same, published as US 2017-0276447 A1 on Sep. 28, 2017 and issued as U.S. Pat. No. 10,267,585 B2 on Apr. 23, 2019 (herein "the '023 Application").

This application yet further claims priority to, incorporates herein by reference, and is a continuation-in-part of U.S. regular utility patent application Ser. No. 15/419,460 to David Foster, filed Jan. 30, 2017 and entitled Trigger-Locking Apparatus, System, and Method for Semiautomatic Firearms, published as US 2017-0219307 A1 on Aug. 3, 2017 and issued as U.S. Pat. No. 10,254,067 B2 on Apr. 9, 2019 (herein "the '460 Application").

This application additionally claims priority to and incorporates herein by reference the US provisional patent applications to which the '985 Application, '023 Application, and the '460 Application claim priority and incorporate by reference, namely U.S. provisional patent application No. 62/311,807 to David Foster, filed Mar. 22, 2016 and entitled Trigger Having a Moveable Sear and Firearms Incorporating Same (herein "the '807 Application"), and U.S. provisional patent application No. 62/288,385 to David Foster, filed Jan. 28, 2016 and entitled Timing Apparatus, System, and Method for Dual Mode Trigger for Semiautomatic Firearms (herein "the '385 Application").

FEDERALLY SPONSORED RESEARCH OR DEVELOPMENT

None.

TECHNICAL FIELD

The present invention relates generally to firearms, and more particularly to improvements to trigger systems for semiautomatic firearms.

BACKGROUND

Selectable dual mode triggers for semiautomatic firearms are known, which include triggers capable of actuating and firing rounds on both pull and release of the trigger. Examples of such systems are disclosed in U.S. Pat. No. 8,667,881 B1 to Hawbaker, granted 2014 Mar. 11 (herein "the '881 Patent"), and U.S. Pat. No. 8,820,211 B1 to Hawbaker, granted 2014 Sep. 2 (herein "the '211 Patent") (collectively "the Hawbaker patents"), both of which are incorporated herein by reference. The characteristics of selecting modes of actuation in which only one round is discharged with one function of the trigger was approved by the ATF and granted the patents mentioned above and incorporated herein.

The introduction of a trigger that actuates on both pull and release presents several challenges, including how to effectively, conveniently, and intuitively switch between pull-and-release firing mode and conventional semi-automatic firing mode.

SUMMARY

The present invention elegantly overcomes various drawbacks and limitations of past systems and provides numerous additional benefits as will be apparent to persons of skill in the art. For example, provided in various example embodiments is a semi-automatic firearm, comprising: a trigger configured to be movable from a forward position toward a rearward position by a user pulling the trigger from the forward position toward the rearward position, and configured to be movable from the rearward position toward the forward position by the user releasing the trigger from the rearward position; and a selector switch configured to be movable by the user between at least a first position and a second position. In various example embodiments the semi-automatic firearm may be configured to, when the selector switch is in the first position: restrict movement of the trigger to a first amount; fire upon the user pulling the trigger from the forward position toward the rearward position; and not fire upon the user releasing the trigger from the rearward position. In various example embodiments the semi-automatic firearm may be further configured to, when the selector switch is in the second position: restrict movement of the trigger to a second amount different than the first amount; fire upon the user pulling the trigger from the forward position toward the rearward position; and fire upon the user releasing the trigger from the rearward position. In various example embodiments the selector switch may be configured to be movable by the user between at least the first position, the second position, and a third position, the semi-automatic firearm configured to, when the selector switch is in the third position: restrict movement of the trigger to a third amount less than the first amount and less than the second amount; and prevent the semi-automatic firearm from firing. In various example embodiments the second amount may be more than the first amount. In various example embodiments the third amount may be no movement of the trigger.

Also provided in various example embodiments is a method of selecting between firing modes of a semi-automatic firearm, comprising the steps of: providing a semi-automatic firearm as described herein; moving the selector switch to the first position and causing the semi-automatic firearm to restrict movement of the trigger to the first amount; and firing the semi-automatic firearm by pulling the trigger from the forward position toward the rearward position. In various example embodiments the method may further comprise the steps of: moving the selector switch to the second position and causing the semi-automatic firearm to restrict movement of the trigger to the second amount; firing the semi-automatic firearm by pulling the trigger from the forward position toward the rearward position; and firing the semi-automatic firearm by releasing the trigger from the rearward position. In various example embodiments the method may further comprise the step of causing the semi-automatic firearm to restrict movement of the trigger to the second amount such that the second amount is more than the first amount.

Further provided in various example embodiments is a method of selecting between firing modes of a semi-automatic firearm, comprising the steps of: providing a semi-automatic firearm as described herein; moving the selector switch to the first position and causing the semi-automatic firearm to restrict movement of the trigger to the first amount, and firing the semi-automatic firearm by pulling the trigger from the forward position toward the rearward position; moving the selector switch to the second position and causing the semi-automatic firearm to restrict movement of the trigger to the second amount, and firing the semi-automatic firearm by pulling the trigger from the forward position toward the rearward position, and firing the semi-automatic firearm by releasing the trigger from the rearward position; and moving the selector switch to the third position and causing the semi-automatic firearm to restrict movement of the trigger to the third amount. In various example embodiments the method may further comprise the step of causing the semi-automatic firearm to restrict movement of the trigger to the second amount such that the second amount is more than the first amount. In various example embodiments the method may further comprise the step of causing the semi-automatic firearm to restrict movement of the trigger to the third amount such that the third amount is no movement.

Additionally provided in various example embodiments is a trigger assembly having a trigger element and configured to be installed in a semi-automatic firearm having a selector assembly configured to be movable by a user moving a selector switch between at least a first position and a second position, wherein the selector assembly is configured to restrict movement of the trigger element to a first amount when the trigger assembly is installed in the semi-automatic firearm and the selector switch is in the first position, and to restrict movement of the trigger element to a second amount different than the first amount when the trigger assembly is installed in the semi-automatic firearm and the selector switch is in the second position. In various example embodiments the trigger element may be configured to be movable from a forward position toward a rearward position by a user pulling the trigger element from the forward position toward the rearward position, the trigger element configured to be movable from the rearward position toward the forward position by the user releasing the trigger element from the rearward position. In various example embodiments the trigger element may be configured to fire the semi-automatic firearm upon the user pulling the trigger from the forward position toward the rearward position, and not fire the semi-automatic firearm upon the user releasing the trigger from the rearward position, when the trigger assembly is installed in the semi-automatic firearm and the selector switch is in the first position. In various example embodiments the trigger element may be configured to fire the semi-automatic firearm upon the user pulling the trigger from the forward position toward the rearward position, and to fire the semi-automatic firearm upon the user releasing the trigger from the rearward position, when the trigger assembly is installed in the semi-automatic firearm and the selector switch is in the second position. In various example embodiments the trigger assembly may be configured to be installed in a semi-automatic firearm having a selector assembly configured to be movable by the user moving the selector switch between at least the first position, the second position, and a third position, wherein the selector assembly is configured to restrict movement of the trigger element to a third amount less than the first amount and less than the second amount when the trigger assembly is installed in the semi-automatic firearm and the selector switch is in the third position, wherein the trigger assembly is configured to prevent firing of the semi-automatic firearm by restricting movement of the trigger element to the third amount when the trigger assembly is installed in the semi-automatic firearm and the selector switch is in the third position. In various example embodiments the second amount may be more than the first amount. In various example embodiments the third amount may be no movement of the trigger.

Still further provided in various example embodiments is a kit, comprising: a trigger assembly as described herein, having a trigger element and configured to be installed in a semi-automatic firearm; and a selector assembly configured to be installed in the semi-automatic firearm and to work in conjunction with the trigger assembly when installed in the semi-automatic firearm to: be movable by a user moving a selector switch between at least a first position and a second position; to restrict movement of the trigger element to a first amount when the trigger assembly is installed in the semi-automatic firearm and the selector switch is in the first position; and to restrict movement of the trigger element to a second amount different than the first amount when the trigger assembly is installed in the semi-automatic firearm and the selector switch is in the second position. In various example embodiments the kids may further comprise the selector assembly configured to be movable by the user moving the selector switch between at least the first position, the second position, and a third position; the selector assembly configured to restrict movement of the trigger element to a third amount less than the first amount and less than the second amount when the trigger assembly and the selector assembly are installed in the semi-automatic firearm and the selector switch is in the third position; and the trigger assembly configured to prevent firing of the semi-automatic firearm by restricting movement of the trigger element to the third amount when the trigger assembly and the selector assembly are installed in the semi-automatic firearm and the selector switch is in the third position.

The foregoing summary is illustrative only and is not meant to be exhaustive or limiting. Other aspects, objects, and advantages of various example embodiments will be apparent to those of skill in the art upon reviewing the accompanying drawings, disclosure, and appended claims. These together with other objects of the invention, along with various features of novelty, which characterize the invention, are pointed out with particularity in the claims annexed hereto and forming a part of this disclosure. For a better understanding of the invention, its operating advantages and the specific objects attained by its uses, reference should be had to the accompanying and incorporated drawings, claims and descriptive matter.

BRIEF DESCRIPTION OF THE DRAWINGS

Examples of the invention can be better understood with reference to the following figures. The components within the figures are not necessarily to scale, emphasis instead being placed on clearly illustrating example aspects of the invention. It will be understood that certain components and details may not appear in the figures to assist in more clearly describing the invention. Reference numerals identifying components in one figure apply equally to the same components when they appear in other figures. For example, the reference numerals appearing in FIG. 2A apply equally to the same components appearing in FIG. 2 and FIGS. 2B through 2J, and the reference numerals appearing in FIG. 3A apply equally to the same components appearing in FIG. 3 and FIGS. 3B through 3N.

Additionally, one or more alternative embodiments having the same functionality as claimed herein are depicted and described in either the '850 Application or the '672 Application or both, incorporated herein by reference.

The invention is not limited to what is shown in these example figures. The figures, drawings, and photographs in the applications incorporated herein provide further example embodiments and alternatives. The invention is broader than the examples shown in any figures and covers anything that falls within any of the claims.

DETAILED DESCRIPTION OF EXAMPLE EMBODIMENTS

Reference will now be made in detail to some specific example embodiments, including any best mode contemplated by the inventor. Examples of these specific embodiments are illustrated in the accompanying drawings. While the invention is described in conjunction with these specific embodiments, it will be understood that it is not intended to limit the invention to the described or illustrated embodiments. On the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments may be implemented without some or all of these features or specific details. In other instances, components and procedures well known to persons of skill in the art have not been described in detail in order not to obscure inventive aspects.

Various techniques and mechanisms will sometimes be described in singular form for clarity. However, it should be noted that some embodiments may include multiple iterations of a technique or multiple components, mechanisms, and the like, unless noted otherwise. Similarly, various steps of the methods shown and described herein are not necessarily performed in the order indicated, or performed at all in certain embodiments. Accordingly, some implementations of the methods discussed herein may include more or fewer steps than those shown or described.

Further, the example techniques and mechanisms described herein will sometimes describe a connection, relationship or communication between two or more items or entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection unless otherwise noted.

Figure 1:
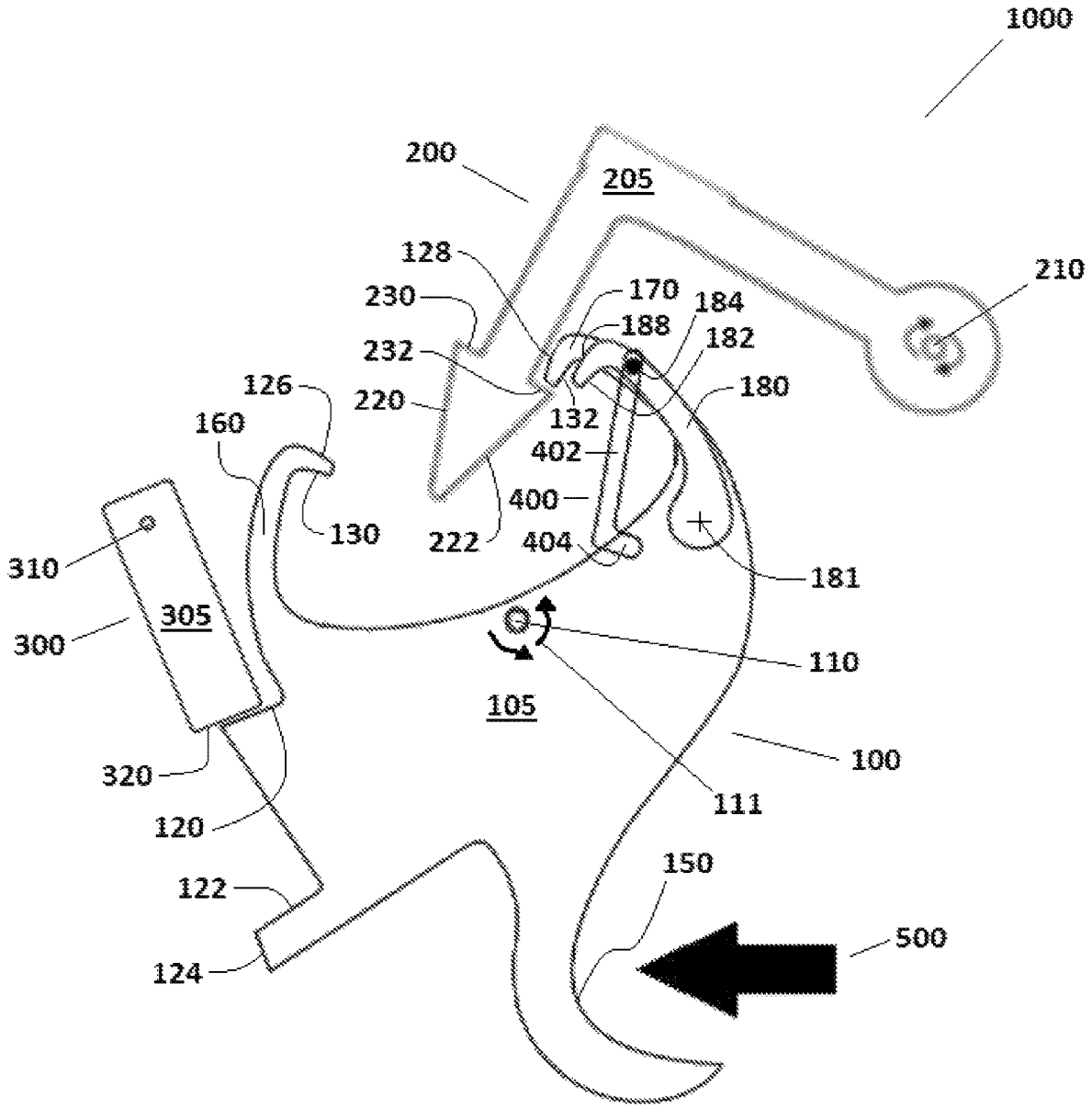
FIG. 1 illustrates example components of a trigger, selector, and hammer as installed in an example firearm (not shown) according to one example embodiment, with the selector shown positioned in safe mode, completely or essentially completely restricting movement of the trigger in the rearward direction (as indicated by the direction of arrow 500 in FIG. 1).
Figure 2:
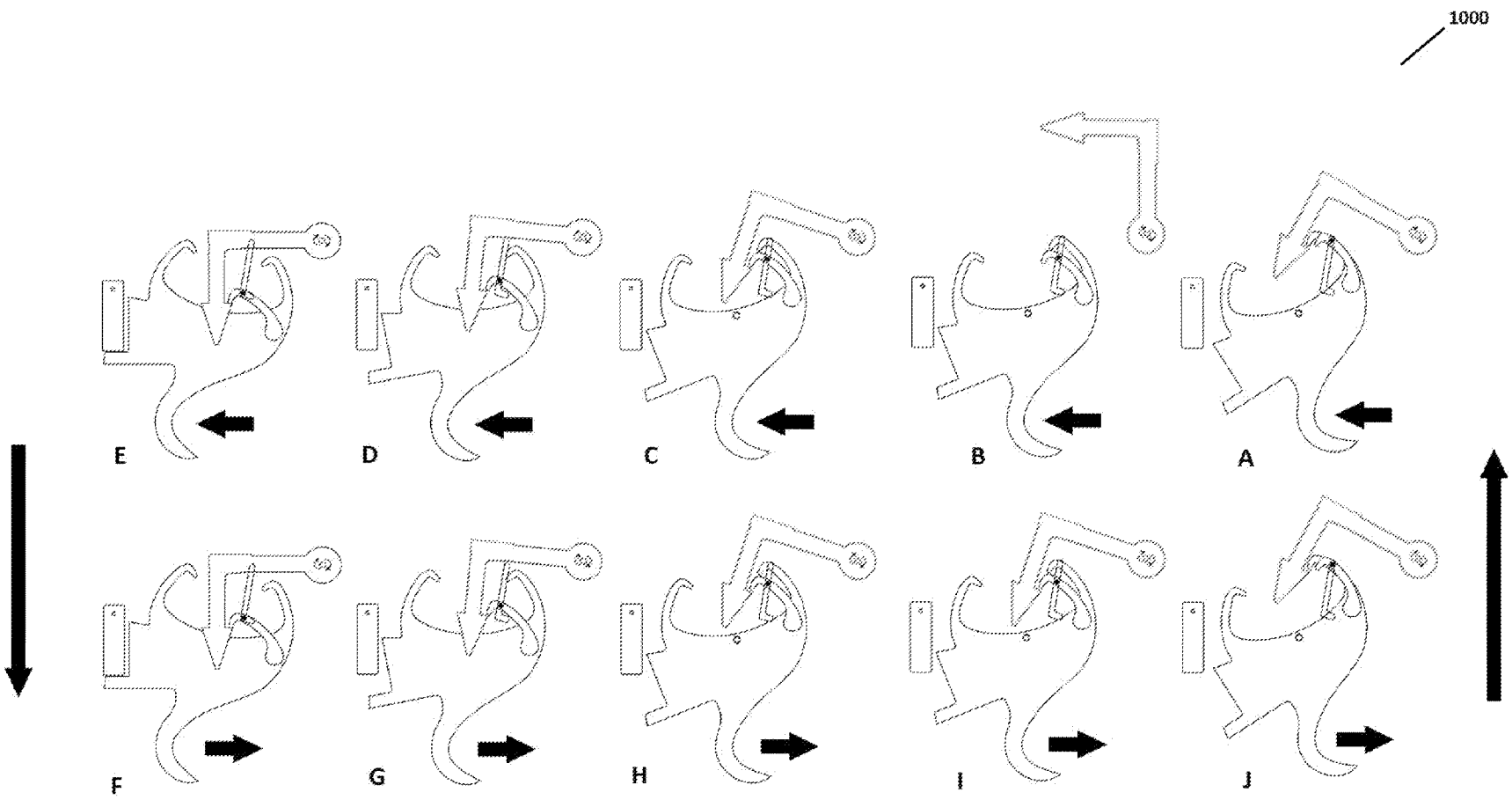
FIG. 2 illustrates the example components of a trigger, selector, and hammer as installed in an example firearm (not shown) of FIG. 1, with the selector shown positioned in semi-automatic firing mode and allowing additional rearward movement of the trigger to fire the firearm upon pulling the trigger but not upon releasing the trigger, depicting successive interaction of the example components in semi-automatic firing mode as the trigger is pulled rearward from a forward position (A through E), and then released from the rearward position and returned to the forward position (F through J).
Figure 2A:
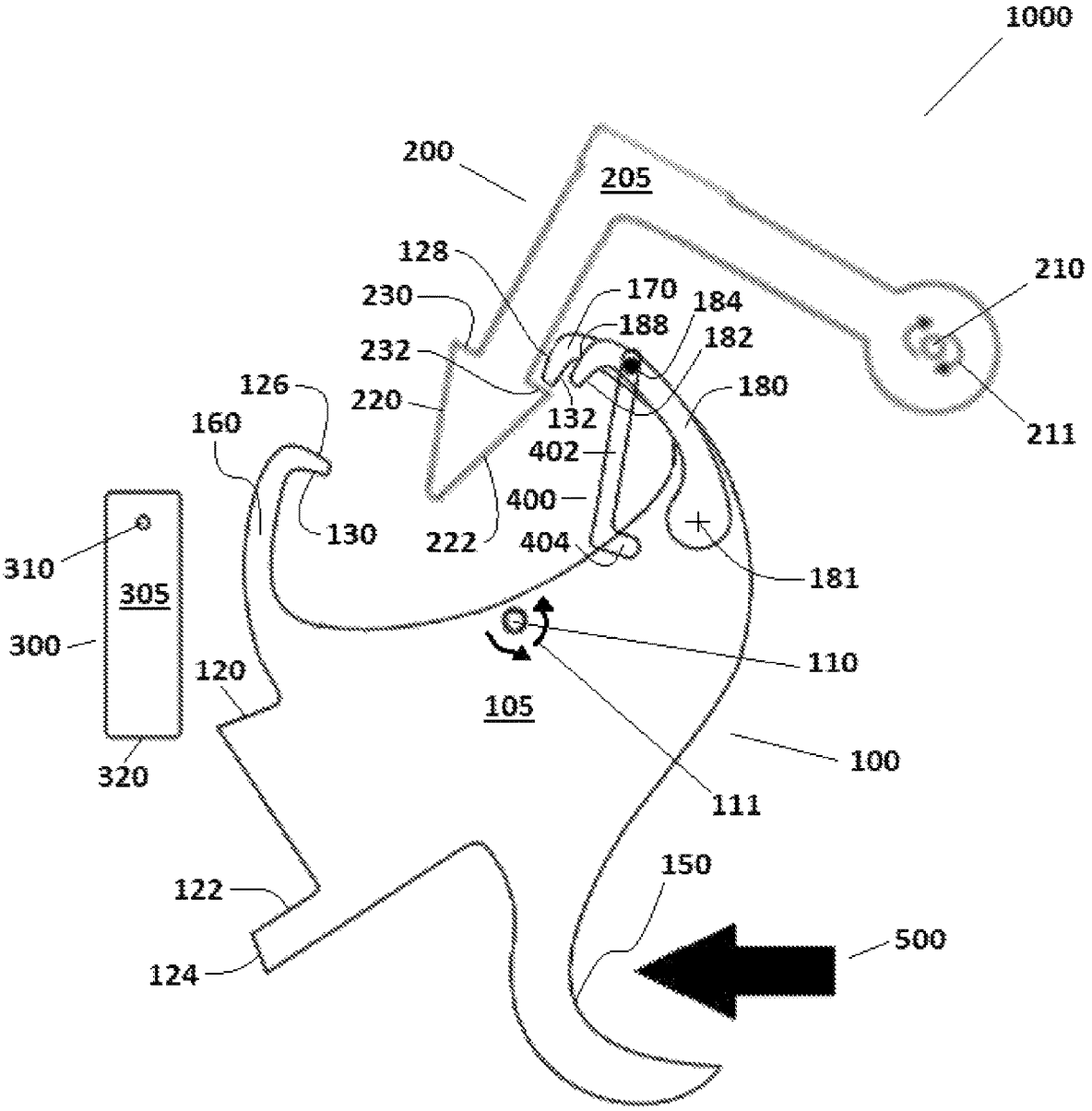
FIGS. 2A through 2E are closer views of the corresponding successive positions A through E of FIG. 2, showing more clearly the example interrelationships of the example components of a trigger, selector, and hammer as installed in an example firearm (not shown) when the selector is positioned in semi-automatic firing mode, allowing additional rearward movement of the trigger to fire the firearm upon pulling the trigger but not upon releasing the trigger, depicting successive interaction of the example components in semi-automatic firing mode as the trigger is pulled rearward from the forward position.
Figure 2B:
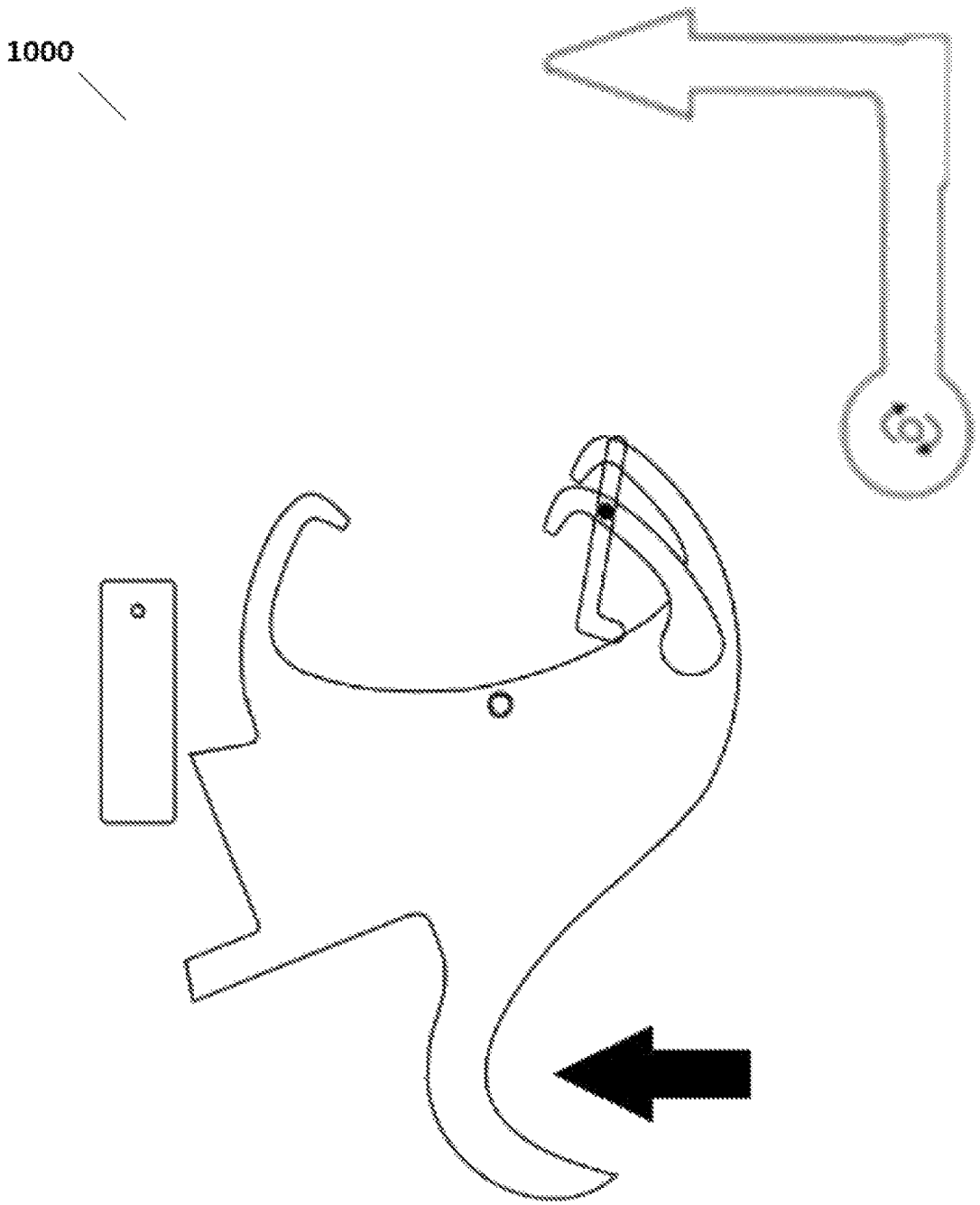

Referring now to the drawings in detail wherein reference numerals identifying components in one figure apply equally to the same components when they appear in other figures, there are shown various aspects of an example multi-mode firearm, trigger, kit, and methods of use. FIGS. 1, 2A, and 3A illustrate a trigger assembly 1000 having a trigger element 105 and configured to be installed in a semi-automatic firearm (for clarity, the rest of the firearm is not shown in FIGS. 1 through 3N, but portions are shown in the documents incorporated herein by reference) having a selector assembly 300 configured to be movable by a user (not shown) moving a selector switch 305 between at least a first position (e.g., as shown in FIG. 2A) and a second position (e.g., as shown in FIG. 3A), wherein the selector assembly 300 is configured to restrict movement of the trigger element 105 to a first amount (e.g., the arcuate distance between first selector interface surface 320 of selector assembly 300 and first trigger interface surface 122 as shown in FIG. 2A) when the trigger assembly 1000 is installed in the semi-automatic firearm (not shown) and the selector switch 305 is in the first position (e.g., as shown in FIG. 2A), and to restrict movement of the trigger element 105 to a second amount (e.g., the arcuate distance between second selector interface surface 324 of selector assembly 300 and second trigger interface surface 124 as shown in FIG. 3A) different than the first amount when the trigger assembly 1000 is installed in the semi-automatic firearm (not shown) and the selector switch 305 is in the second position (e.g., as shown in FIG. 3A). With continuing reference to FIGS. 1, 2A, and 3A, in various example embodiments the trigger element 105 may be configured to be movable from a forward position (e.g., as shown in FIGS. 1, 2A, 2J, 3A, 3N) toward a rearward position (e.g., as shown in FIGS. 2E, 2F, or alternatively in FIGS. 3G, 3H) by a user (not shown) pulling the trigger element 105 from the forward position toward the rearward position (e.g., as shown in FIGS. 2A through 2E, or alternatively in FIGS. 3A through 3G), the trigger element 105 configured to be movable from the rearward position toward the forward position (e.g., as shown in FIGS. 2F through 2J, or alternatively in FIGS. 3H through 3N) by the user (not shown) releasing the trigger element 105 from the rearward position (e.g., as shown in FIGS. 2E, 2F, or alternatively in FIGS. 3G, 3H).

In the example embodiment shown in the present figures, the trigger element 105 pivots about a trigger pivot 110, which may comprise a sleeve movable around an axle or pin (not shown). A spring (not shown) may be provided to urge the trigger element 105 in the forward rotational direction 111 shown in FIGS. 1, 2A, and 3A and to thus move the trigger element 105 in the forward rotational direction 111 to the forward position shown in FIGS. 1, 2A, and 3A, when a user (not shown) releases the trigger element 105 from any of the positions shown in FIGS. 2B through 2I or 3B through 3M.

In the example embodiment shown in the present figures, the selector assembly 300 comprises a selector switch 305 that pivots about a selector pivot 310 and has at least one selector interface surface, such as a first selector interface surface 320 and in the example embodiment shown in the figures, a second selector interface surface 324 (FIG. 3A). The selector assembly 300 can be moved into different positions with respect to the trigger assembly 1000 by the user selectably moving the selector switch 305. For instance the selector assembly 300 can be moved to the position shown in FIGS. 2 and 2A through 2J, which allows a first amount of movement of the trigger 100 and thus allows the trigger assembly 1000 to operate in normal semi-automatic firing mode. In various example embodiments the selector assembly 300 can also be moved to the position shown in FIGS. 3 and 3A through 3N, which allows a second amount of movement of the trigger 100 greater than the first amount of movement shown in FIGS. 2 and 2A through 2J, the second, greater amount of movement allowing the trigger assembly 1000 to fire the firearm upon both pulling and releasing the trigger (pull-and-release firing mode). Additionally, in various example embodiments the selector assembly 300 can be moved to the position shown in FIG. 1, which prevents further rearward movement of the trigger 100 sufficiently to prevent firing of the firearm (i.e., safe mode).

It is understood that the geometry shown in figures is just example geometry, and that other geometries and structures could be provided to accomplish the same or similar functionality and fall within the intended scope and spirit of the invention. For example, unless specifically claimed, the invention is not limited to the order in which the components interact nor to the order in which modes are selected by moving the selector switch 305. Additionally, it is understood that the selector assembly 300 may comprise multiple structures in kinematic relationship, and a separate selector switch 305 having any suitable geometry, as long as it is connected with the selector assembly 300 so as to selectably cause engagement and disengagement of the selector assembly 300 with the trigger assembly 1000 in different orientations to accomplish the selection of different firing modes by changing the amount of available movement of the trigger 100.

Turning specifically to FIGS. 2 and 2A through 2J, depicted is an example embodiment where the selector switch 305 is in a first position corresponding to normal semi-automatic firing mode, and the selector assembly 300 is configured to restrict movement of the trigger element 105 to a first amount (e.g., the arcuate distance between first selector interface surface 320 of selector assembly 300 and first trigger interface surface 122 as shown in FIG. 2A) when the trigger assembly 1000 is installed in the semi-automatic firearm (not shown) and the selector switch 305 is in the first position (e.g., as shown in FIG. 2A). In normal semi-automatic firing mode (see generally, FIG. 2), the trigger element 105 may be configured to fire the semi-automatic firearm (not shown) upon the user (not shown) pulling the trigger 100, for instance by applying force to the pulling surface 150 of the trigger 100 and moving the user's finger in the direction 500 shown in FIG. 2A, and thus moving the trigger element 105 from the forward position toward the rearward position (e.g., as shown in FIGS. 2A through 2E), and not fire the semi-automatic firearm (not shown) upon the user (not shown) releasing the trigger 100, for instance by releasing force from the pulling surface 150 of the trigger 100 and moving the user's finger in the direction 500 shown in FIGS. 2F through 2J, and thus allowing the trigger element 105 that is spring-biased in the forward rotational direction 111 to move from the rearward position toward the forward position (e.g., as shown in FIGS. 2F through 2J), when the trigger assembly 1000 is installed in the semi-automatic firearm (not shown) and the selector switch 305 is in the first position (e.g., as shown in FIG. 2A).

With continuing reference to FIGS. 2 and 2A through 2J, an example embodiment of the trigger assembly 1000 operating in normal semi-automatic firing mode (where the firearm fires upon the user pulling the trigger 100 but does not fire upon the user releasing the trigger 100) will now be described. Beginning at FIG. 2A, the hammer assembly 200 is cocked by rotation of the hammer 205 (for instance by engagement of the hammer 205 with translational movement of the carrier (not shown)) about a hammer pivot 210 against a forward urging force 211 provided by a hammer spring (not shown), for example. The hammer 205 is held in place by engagement of its forward hammer engagement surface 232 with the forward sear engagement surface 132 of the forward sear 128 attached with the trigger 100. As the trigger element 105 begins to move from the forward position (FIG. 2A) toward the rearward position (FIG. 2E), the hammer assembly 200 is released from the cocked position of FIG. 2A to the fired position of FIG. 2B by the rearward rotational movement of the trigger element 105 causing the forward sear engagement surface 132 of the forward sear 128 to move forward and slide off the forward hammer engagement surface 232 of the hammer 205, allowing the hammer 205 to rotate forward about the hammer pivot 210 under the forward urging force 211 and strike the firing pin of the firearm or percussion cap of a cartridge (neither shown), thereby causing the firearm to fire a round (not shown).

Figure 2C:
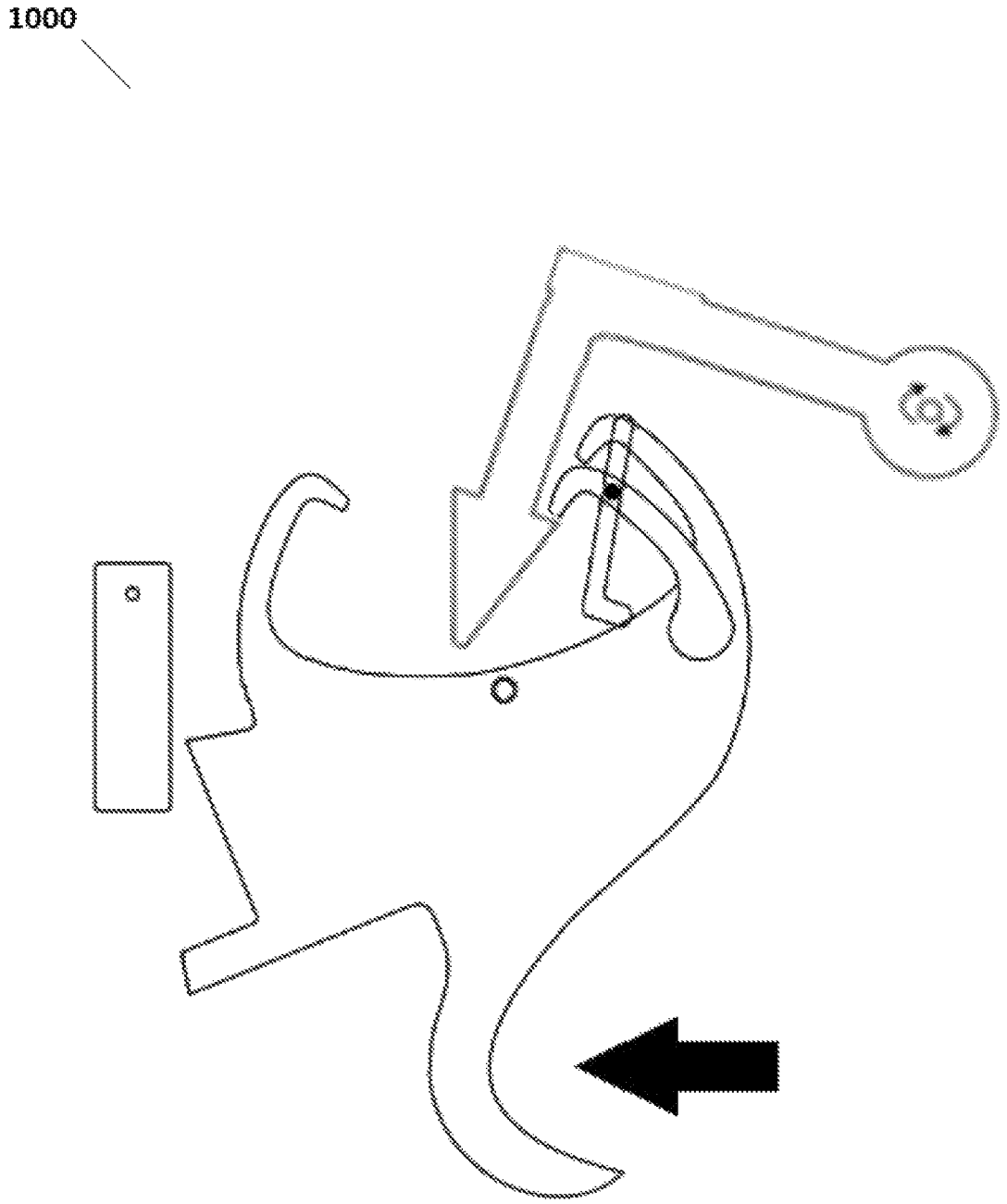
Figure 2D:
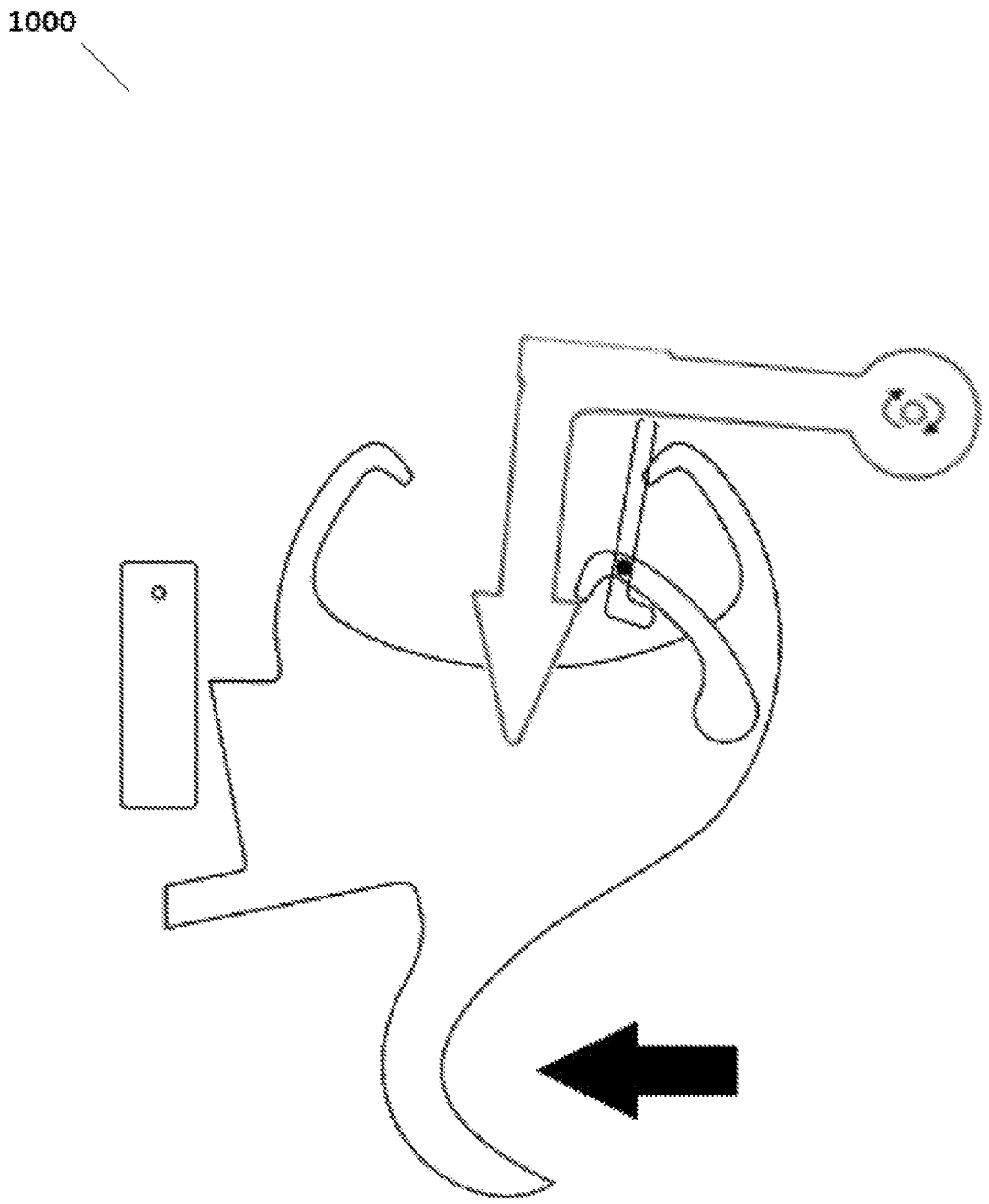
Figure 2E:
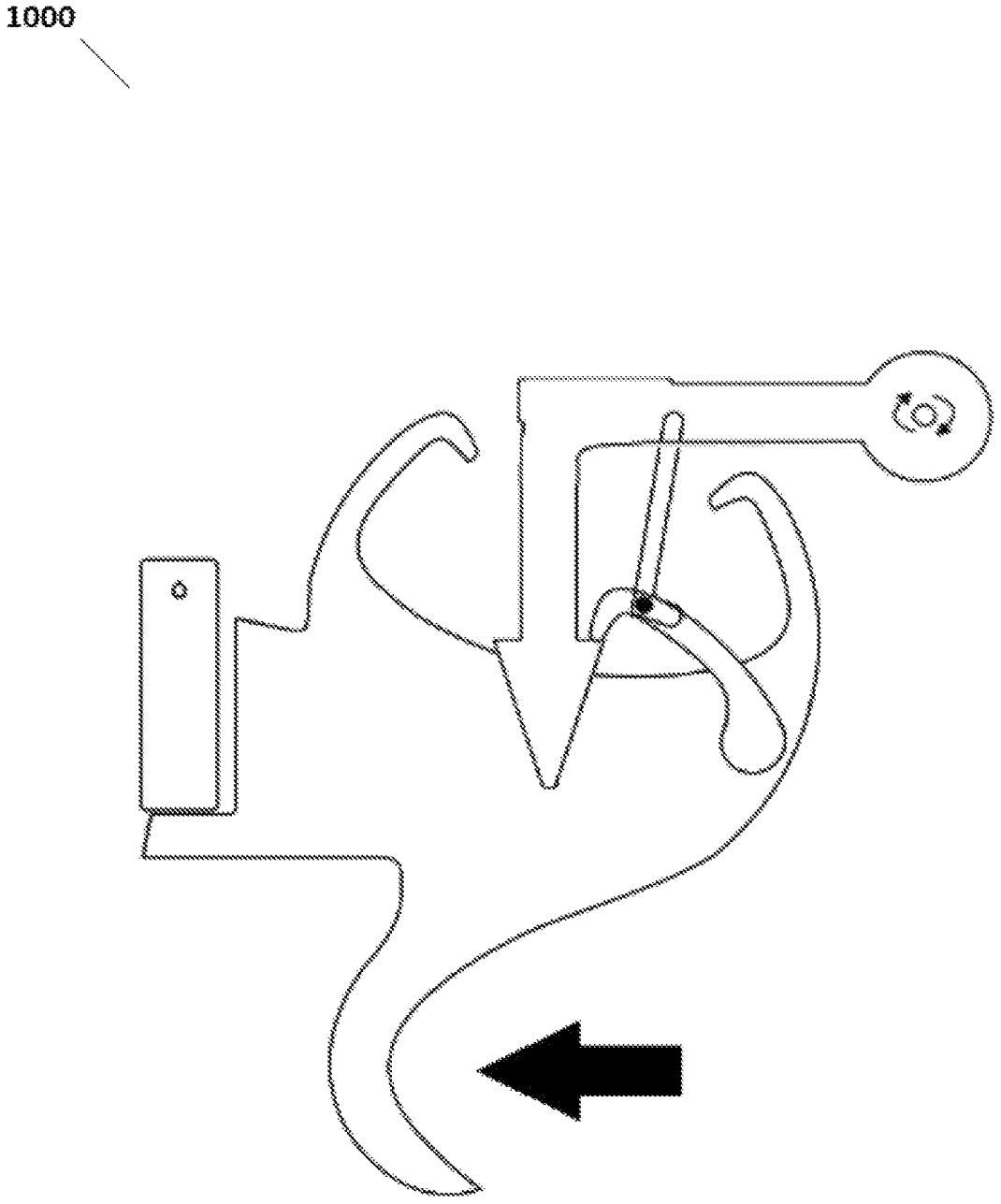
Figure 2F:
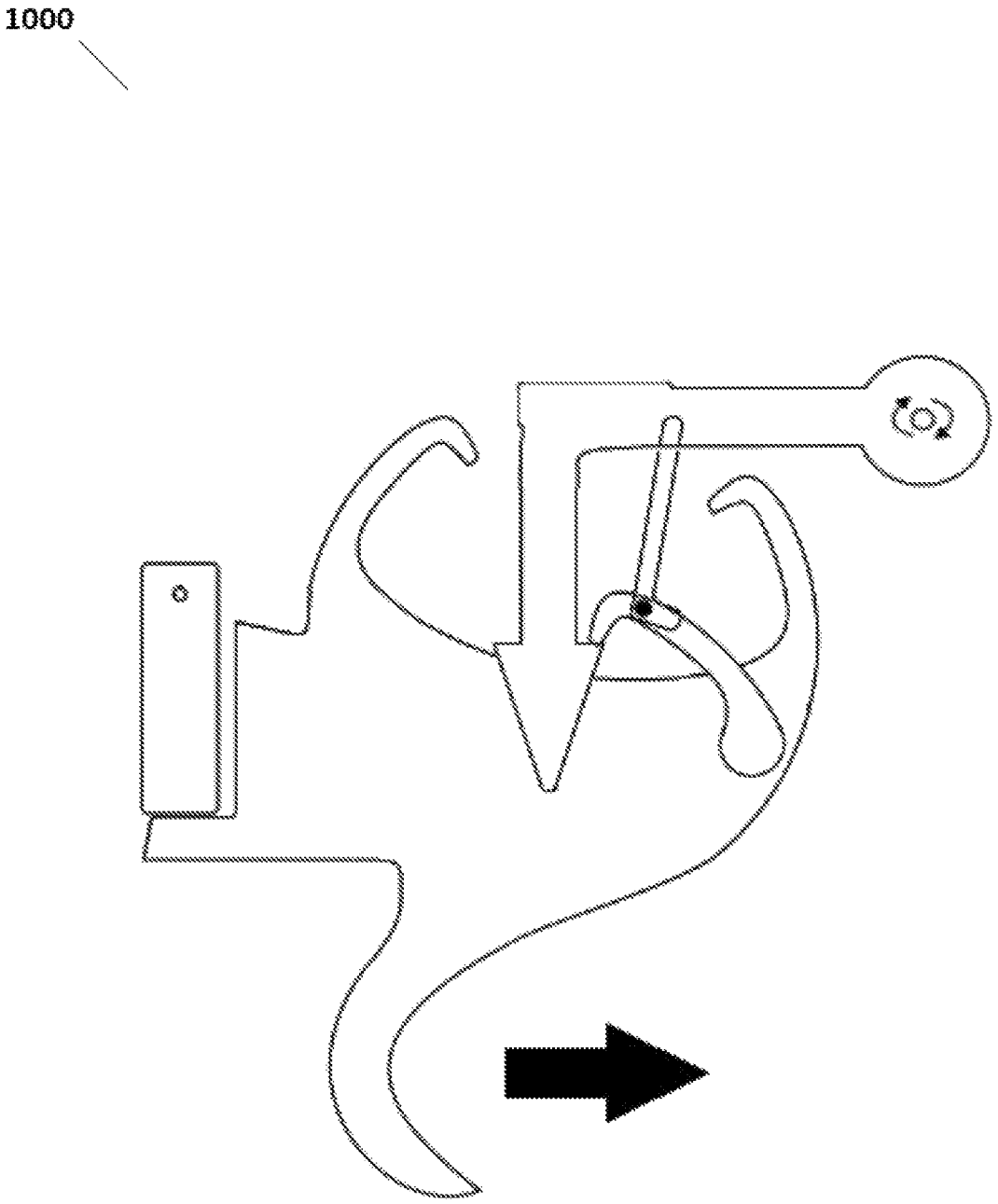
FIGS. 2F through 2J are closer views of the corresponding successive positions F through J of FIG. 2, showing more clearly the example interrelationships of the example components of a trigger, selector, and hammer as installed in an example firearm (not shown) when the selector is positioned in semi-automatic firing mode, allowing additional rearward movement of the trigger to fire the firearm upon pulling the trigger but not upon releasing the trigger, depicting successive interaction of the example components in semi-automatic firing mode as the trigger is released from the rearward position and returns to the forward position.
Figure 2G:
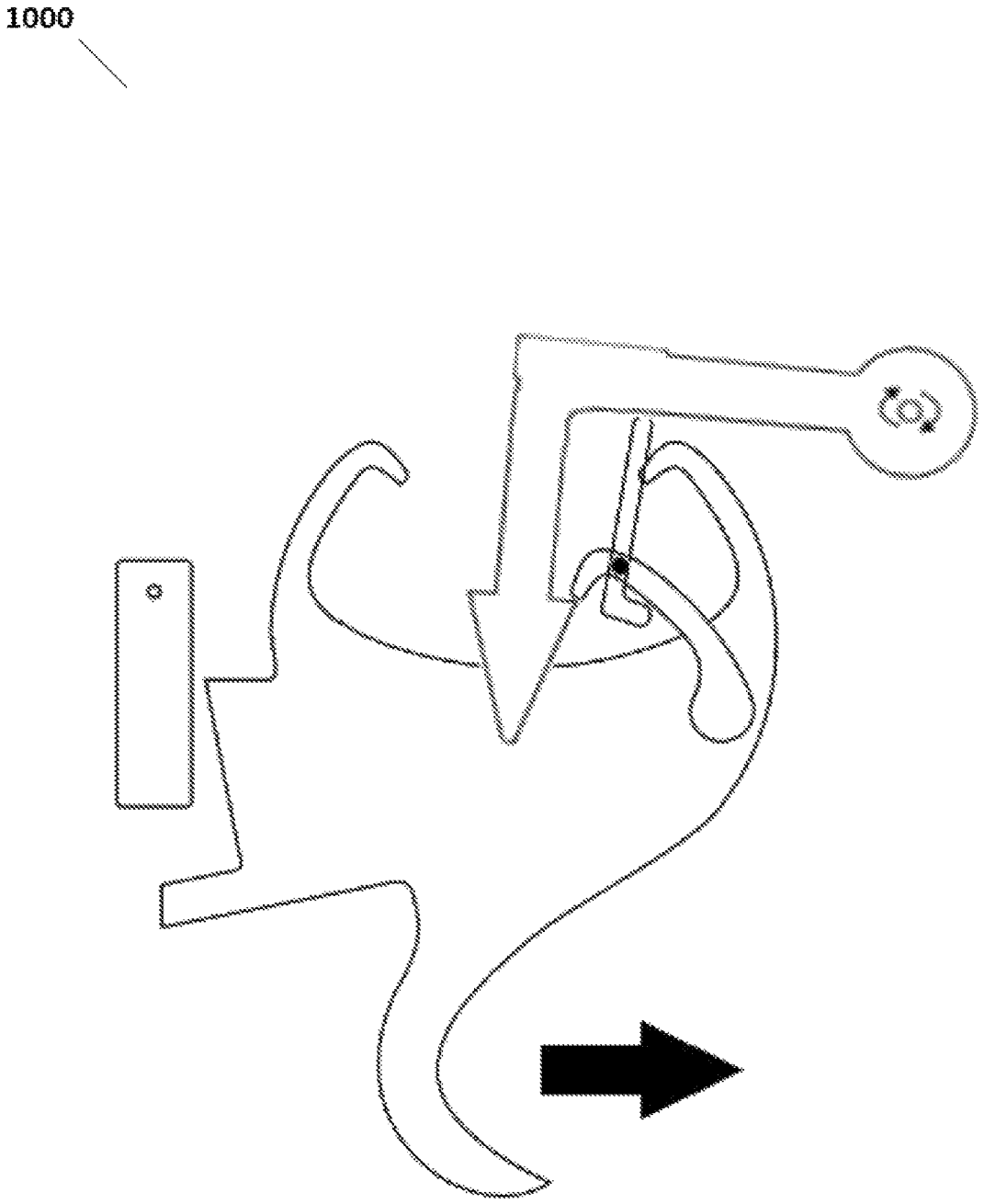
Figure 2H:
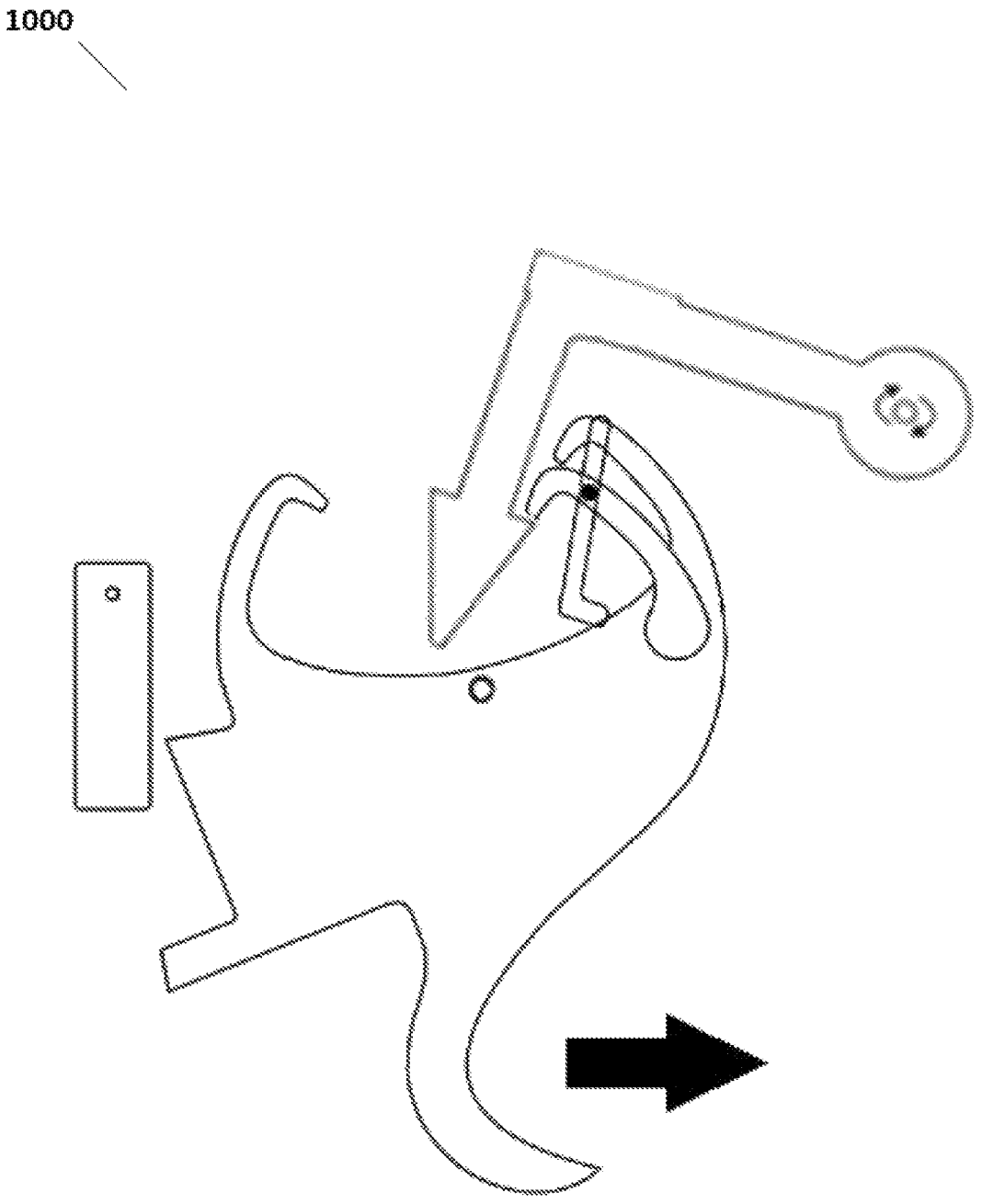
Figure 2I:
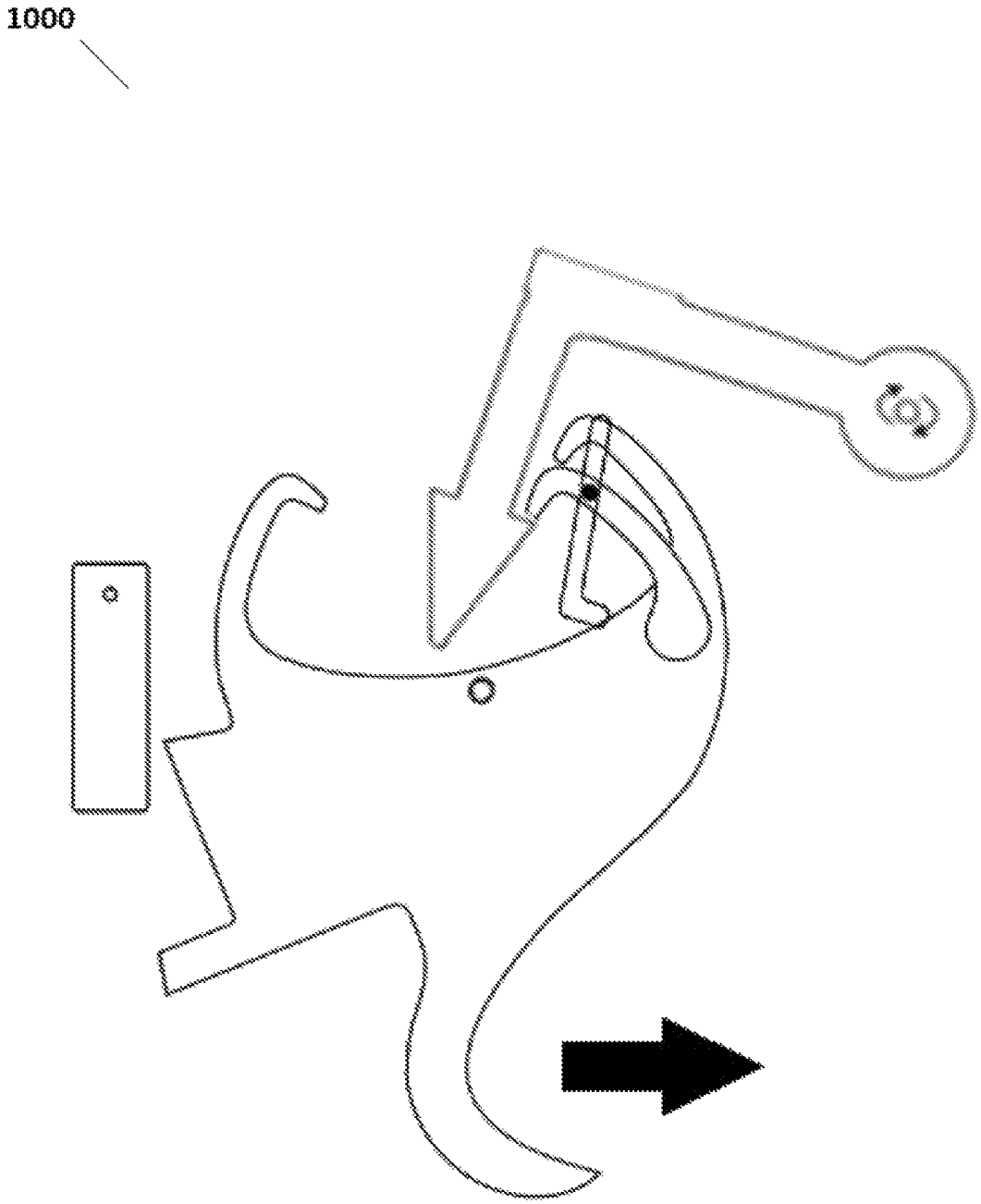

Immediately and almost instantaneously upon firing a round, the carrier or some other mechanism (not shown) engages the hammer assembly 200 and rotates the hammer 205 rearward about the hammer pivot 210 against the forward urging force 211, moving the forward hammer engagement surface 232 of the hammer 205 back past the forward sear engagement surface 132 of the forward sear 128 and into engagement with disconnect engagement surface 182 of the disconnector 188 as shown in FIG. 2C (reference FIG. 2A for part numbering). While this step is depicted as occurring when the trigger 100 is in the position shown in FIG. 2C, it is understood that this step of re-engaging the hammer 205 with the trigger assembly 1000 can occur regardless of the position of the trigger 100. The disconnector 188 comprises an example disconnector structure 180 that is connected with and pivots about the trigger element 105 at rotation point 181. The role of the disconnector 188 is generally to be in position to capture and retain the hammer 205 as the user is pulling or releasing the trigger 100 during cycling of the firearm, and then to transition the hammer 205 to a sear (e.g., 128, 126) as the trigger 100 moves into position for firing. In order for the disconnector 188 to be in the correct position to capture and retain the hammer 205 as the user is pulling or releasing the trigger 100 during cycling of the firearm, a camming mechanism may be provided to guide the movement of the disconnector 188 as the trigger element 105 rotates about the trigger pivot 110. In the example embodiment shown in the present figures, the camming mechanism comprises a pin 184 attached with the disconnector structure 180, where the pin 184 rides in or is otherwise guided by a slot 400 formed into a housing (not shown) for the trigger assembly 1000, or formed into a similar structure adjacent the trigger assembly 1000. For clarity, only the boundary or edges of the slot 400 are shown in the figures. As depicted in FIGS. 2A through 2E, as the user pulls the trigger 100 from the forward position to the rearward position, the disconnector structure 180 pivots about the rotation point 181 and moves the disconnector 188 through a path underneath and rearward of forward sear 128 by the pin 184 moving within the slot 400 from an upper slot portion 402, rearward and downward toward a lower slot portion 404. In the rearward-most position of the trigger 100 in the semi-automatic firing mode (FIG. 2E), the first selector interface 320 of the selector assembly 300 contacts that first trigger interface surface 122 of the trigger 100, stopping further rearward movement of the trigger 100. Then as depicted in FIGS. 2F through 2I, as the user releases the trigger 100 to move from the rearward position to the forward position, the disconnector structure 180 pivots about the rotation point 181 and moves the disconnector 188 through a path underneath and rearward of forward sear 128 by the pin 184 moving within the slot 400 from proximate a lower slot portion 404, forward and upward to an upper slot portion 402. As illustrated in FIG. 2, in FIG. 2I the trigger element 105 is in the same position as in FIG. 2B. But in FIG. 2B the hammer 105 was released and the firearm was fired, while in FIG. 2I the hammer was retained and the firearm was not fired. This is because, due to the order of operations of the disclosed trigger assembly 1000, in FIG. 2I the hammer 205 is being retained by the disconnector 188, while in FIG. 2B the hammer 205 is not being retainer by the disconnector 188. Specifically, as the trigger element 105 pivots about trigger pivot 110 from the position shown in FIG. 2I to the position shown in FIG. 2J (which is the same as the position shown in FIG. 2A), the forward hammer engagement surface 232 of the hammer 205 is handed-off or otherwise transferred from the disconnector engagement surface 182 on the disconnector 188 to the forward sear engagement surface 132 on the forward sear 128, by the disconnector engagement surface 182 of the disconnector 188 sliding off the forward hammer engagement surface 232 of the hammer 205, allowing the forward hammer engagement surface 232 of the hammer 205 to jump up, under the forward urging force 211 on the hammer 205, to the forward sear engagement surface 132 on the forward sear 128. Then the trigger element 105 is in the position shown in FIG. 2J, which is the same position shown in FIG. 2A, and the firearm is ready to be fired again upon pulling the trigger 100 as shown in FIG. 2B, and the cycle repeats, which is normal semi-automatic firing mode.

Figure 3:
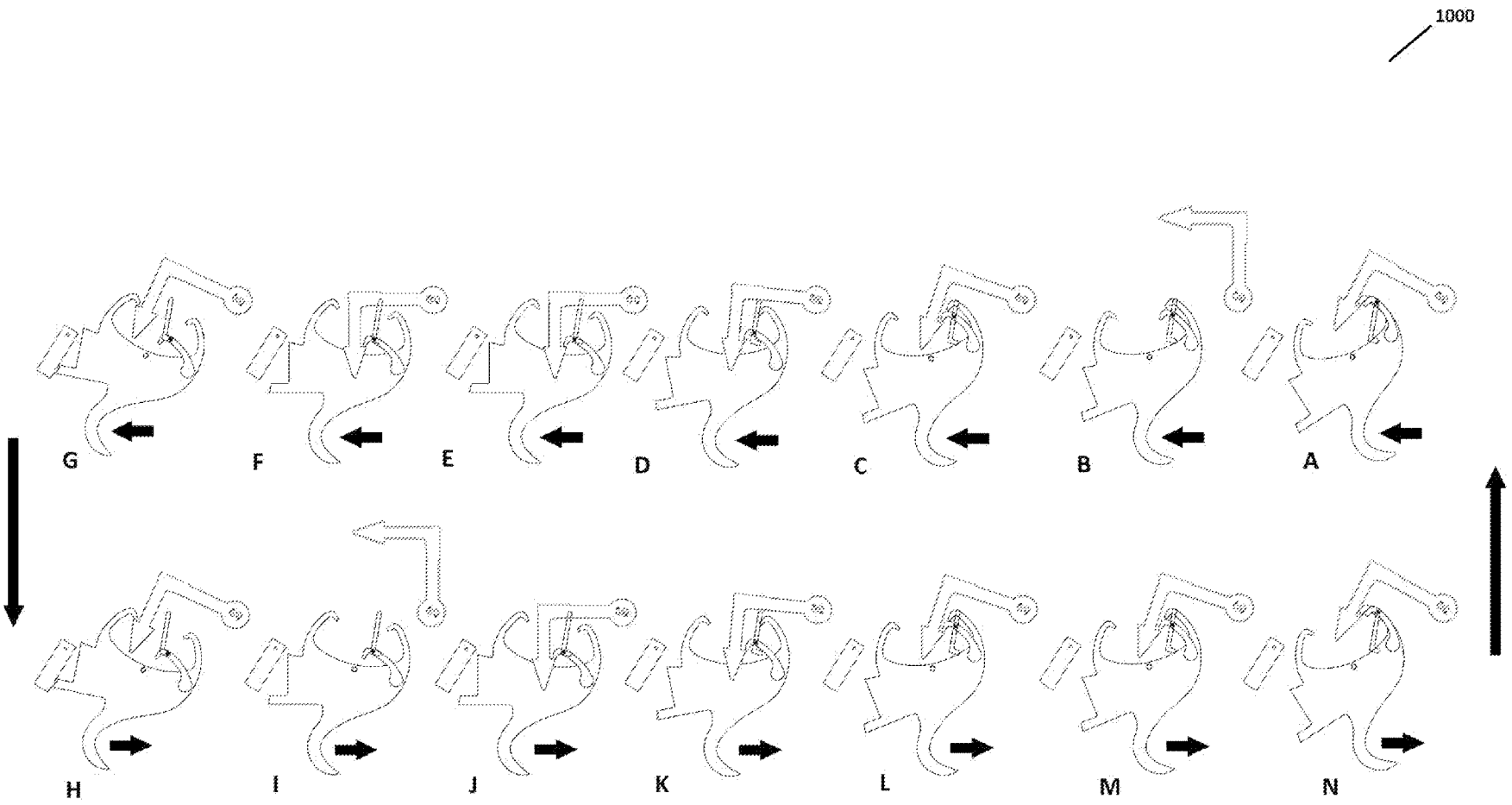
FIG. 3 illustrates the example components of a trigger, selector, and hammer as installed in an example firearm (not shown) of FIG. 1, with the selector shown positioned in fire-upon-pull-and-release firing mode and allowing still further rearward movement of the trigger to fire the firearm upon pulling the trigger and also upon releasing the trigger, depicting successive interaction of the example components in fire-upon-pull-and-release firing mode as the trigger is pulled rearward from a forward position (A through G), and then released from the rearward position and returned to the forward position (H through N).
Figure 3A:
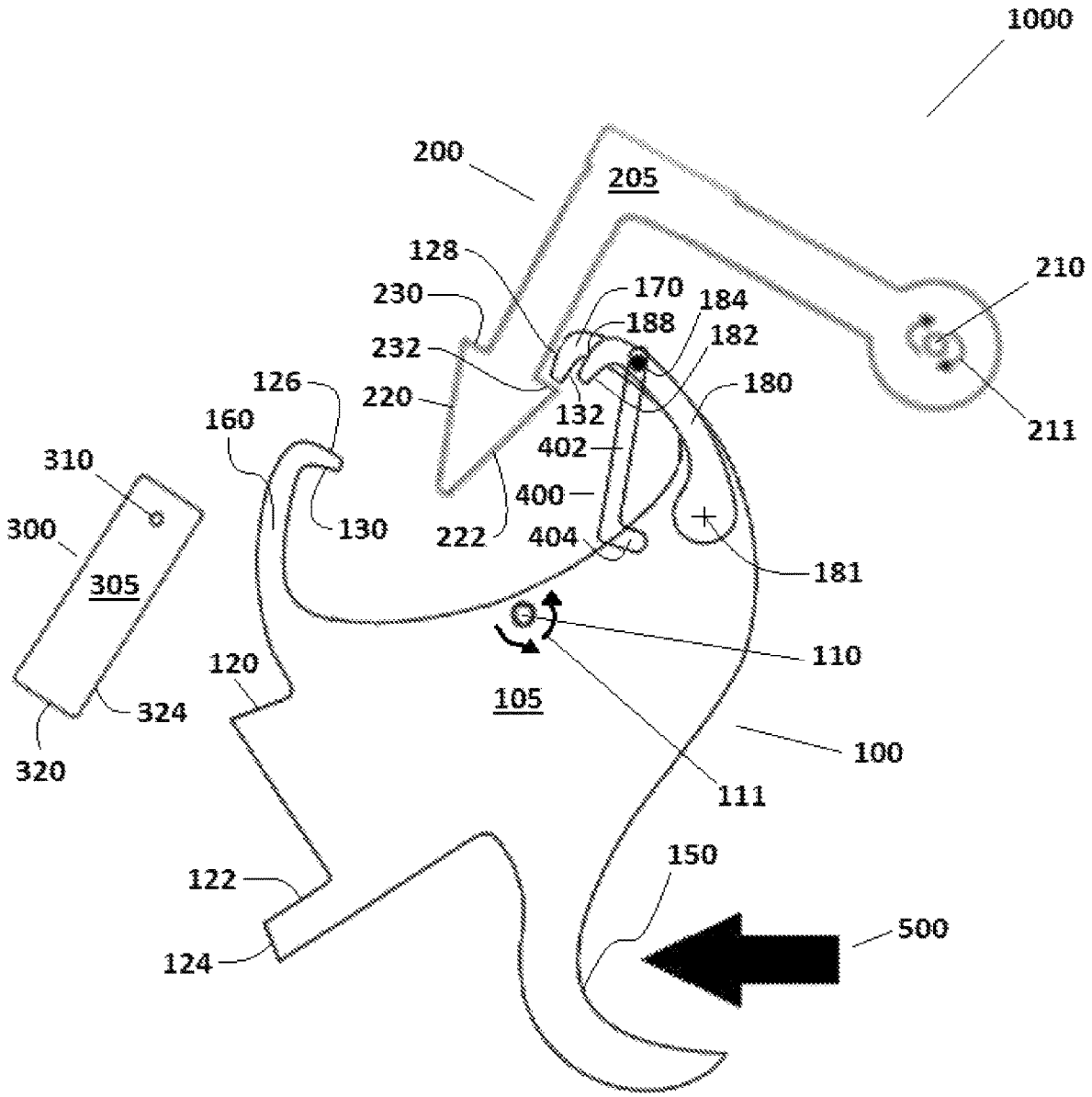
FIGS. 3A through 3G are closer views of the corresponding successive positions A through G of FIG. 3, showing more clearly the example interrelationships of the example components of a trigger, selector, and hammer as installed in an example firearm (not shown) when the selector is positioned in fire-upon-pull-and-release firing mode, allowing still further rearward movement of the trigger to fire the firearm upon pulling the trigger and upon releasing the trigger, depicting successive interaction of the example components in fire-upon-pull-and-release firing mode as the trigger is pulled rearward from the forward position.
Figure 3B:
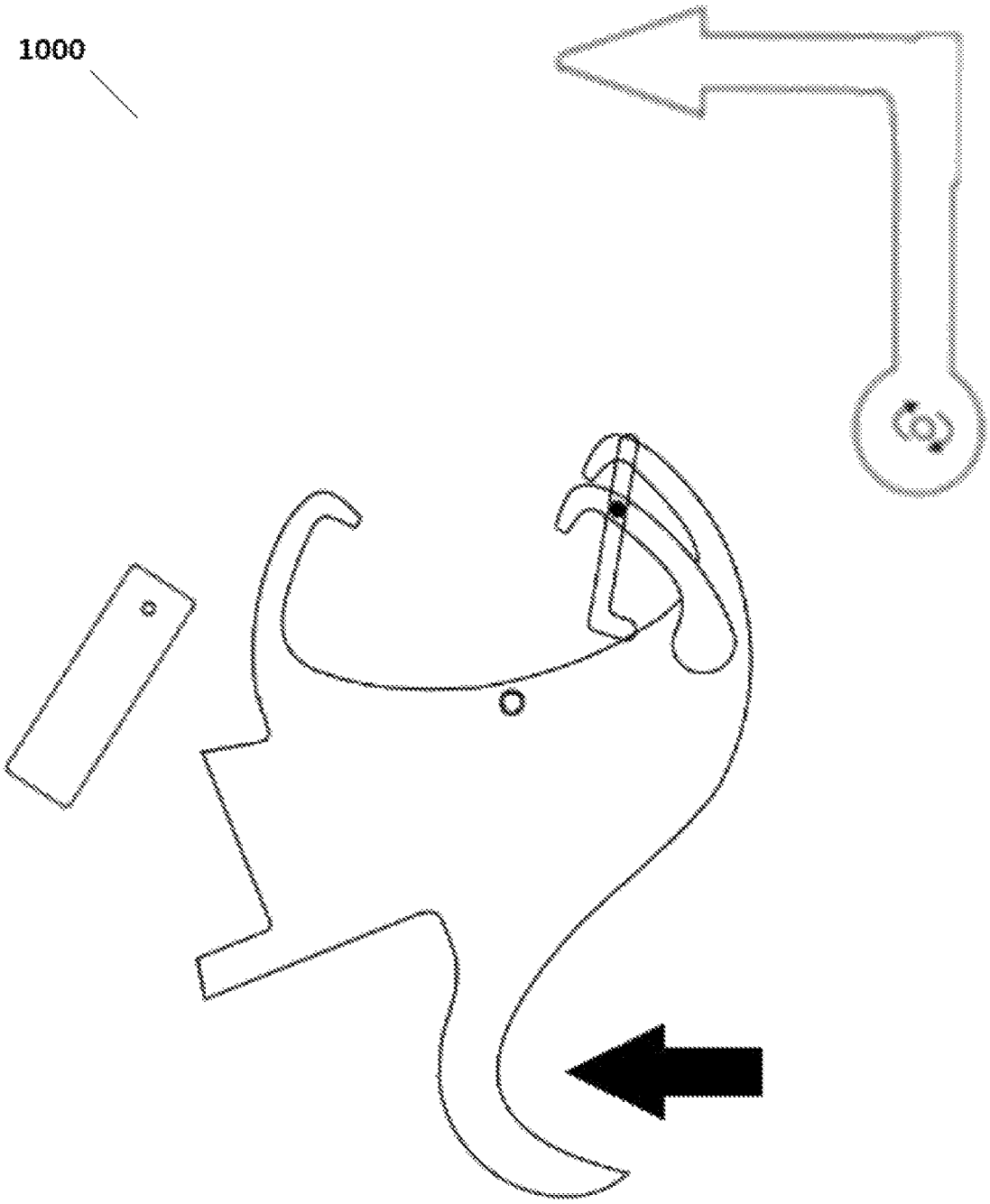
Figure 3C:
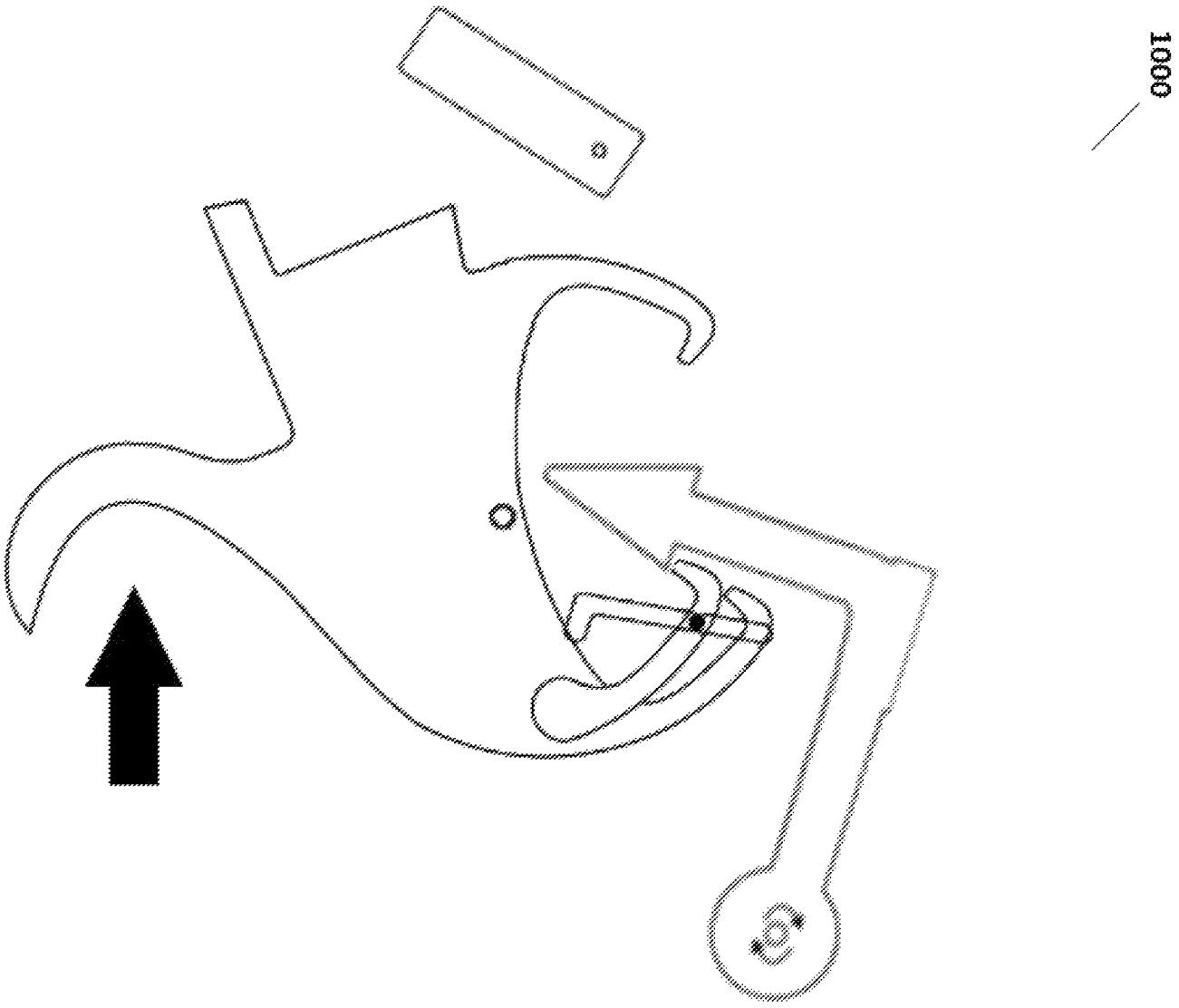
Figure 3D:
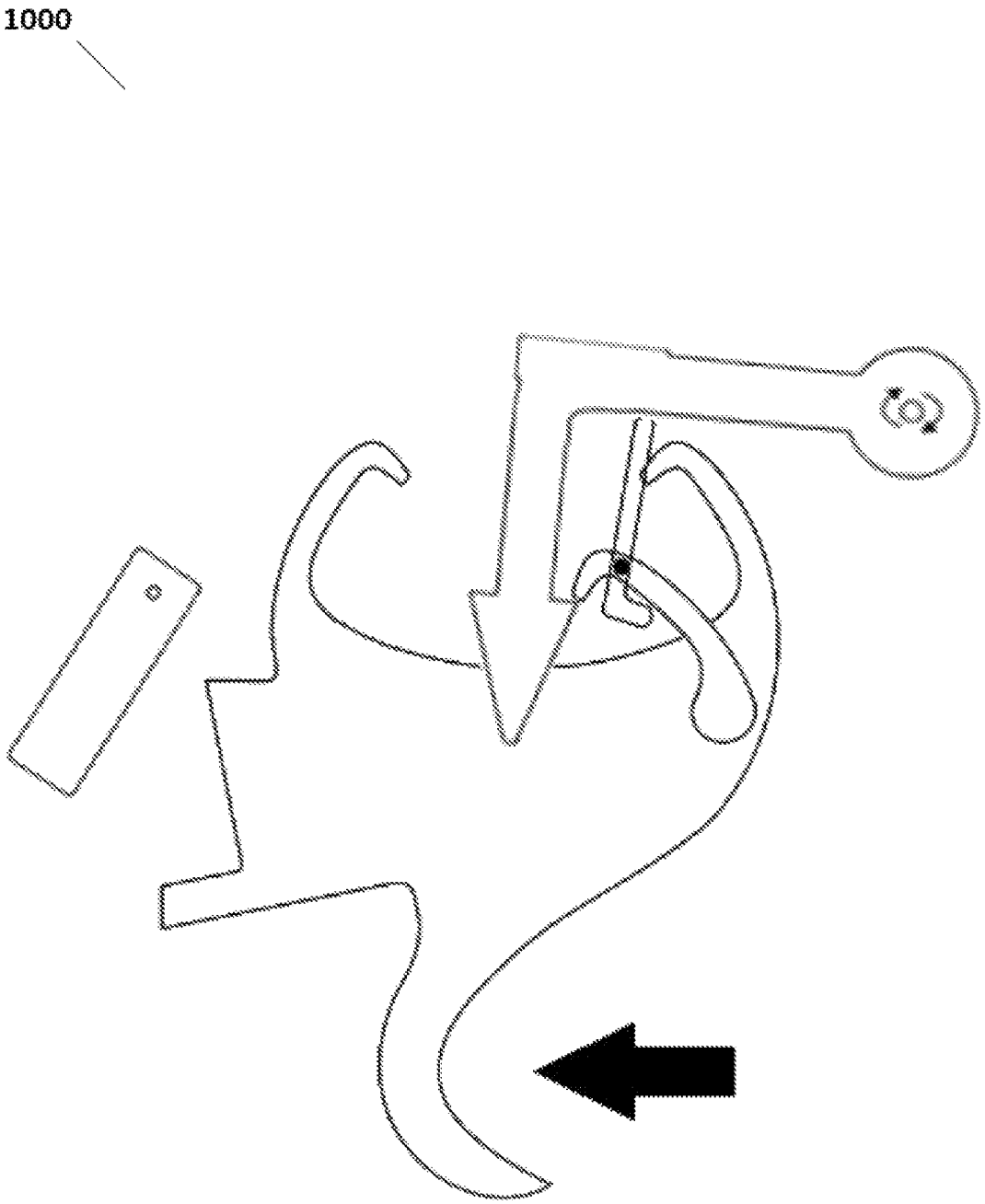
Figure 3E:
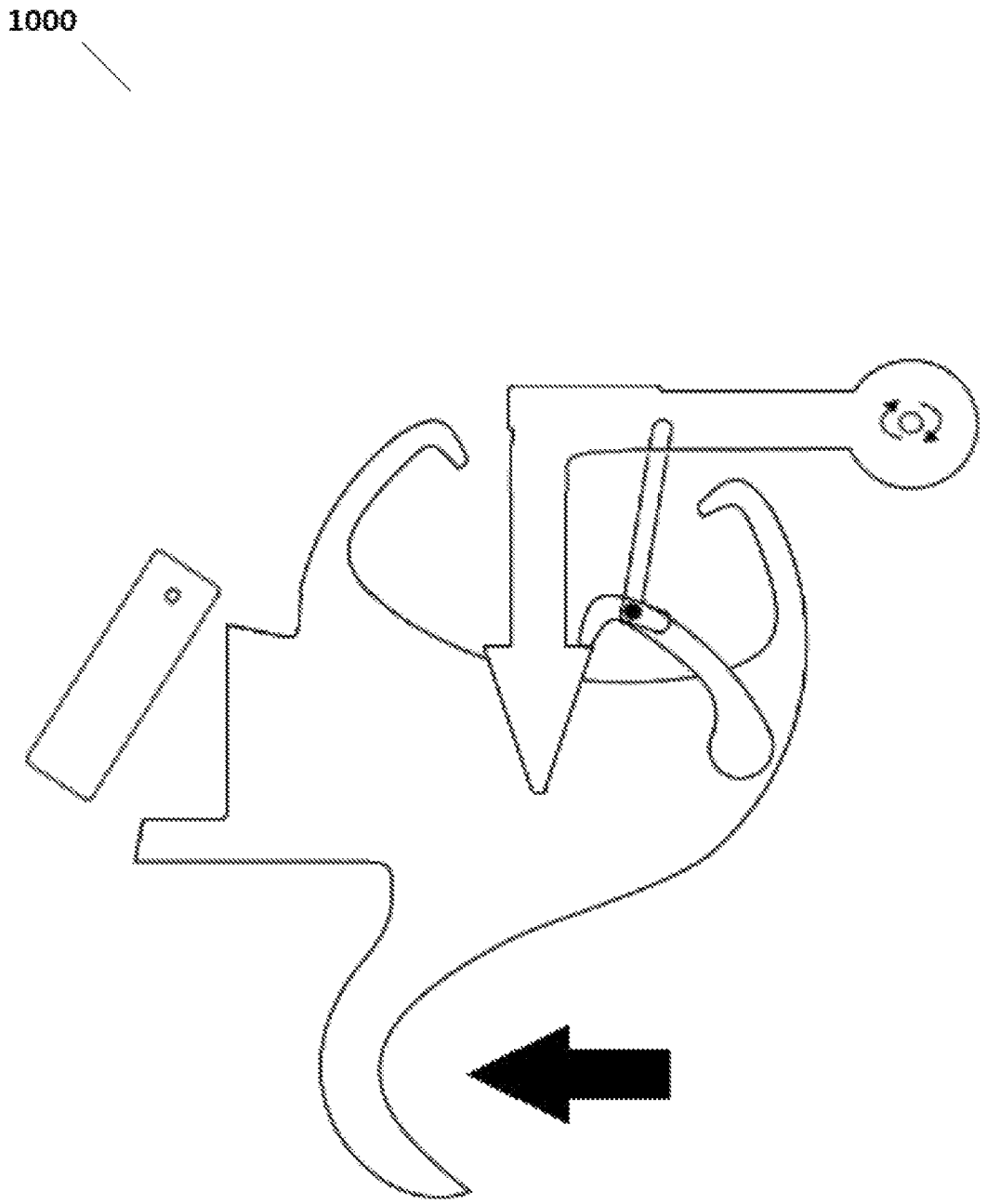
Figure 3F:
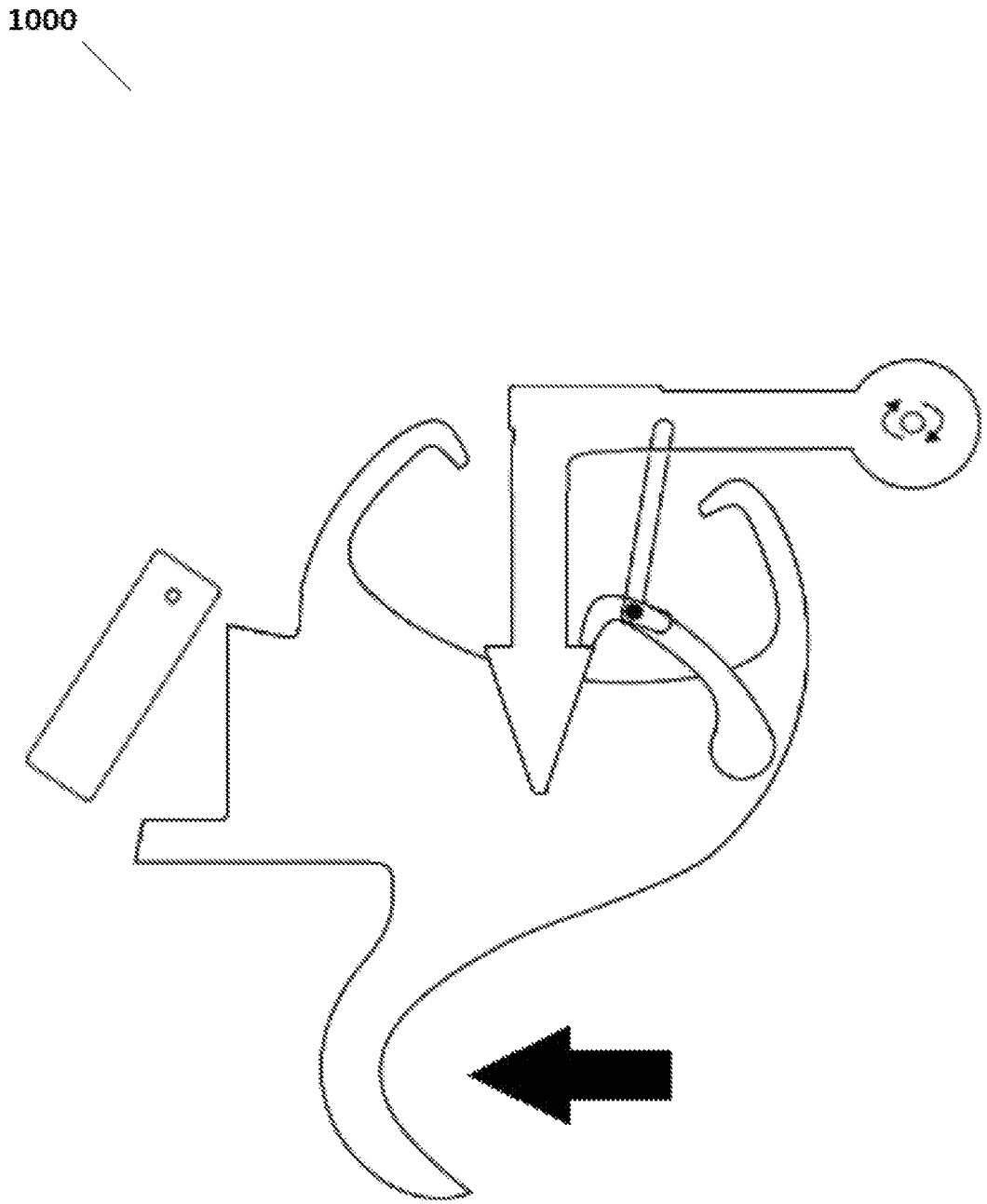
Figure 3G:
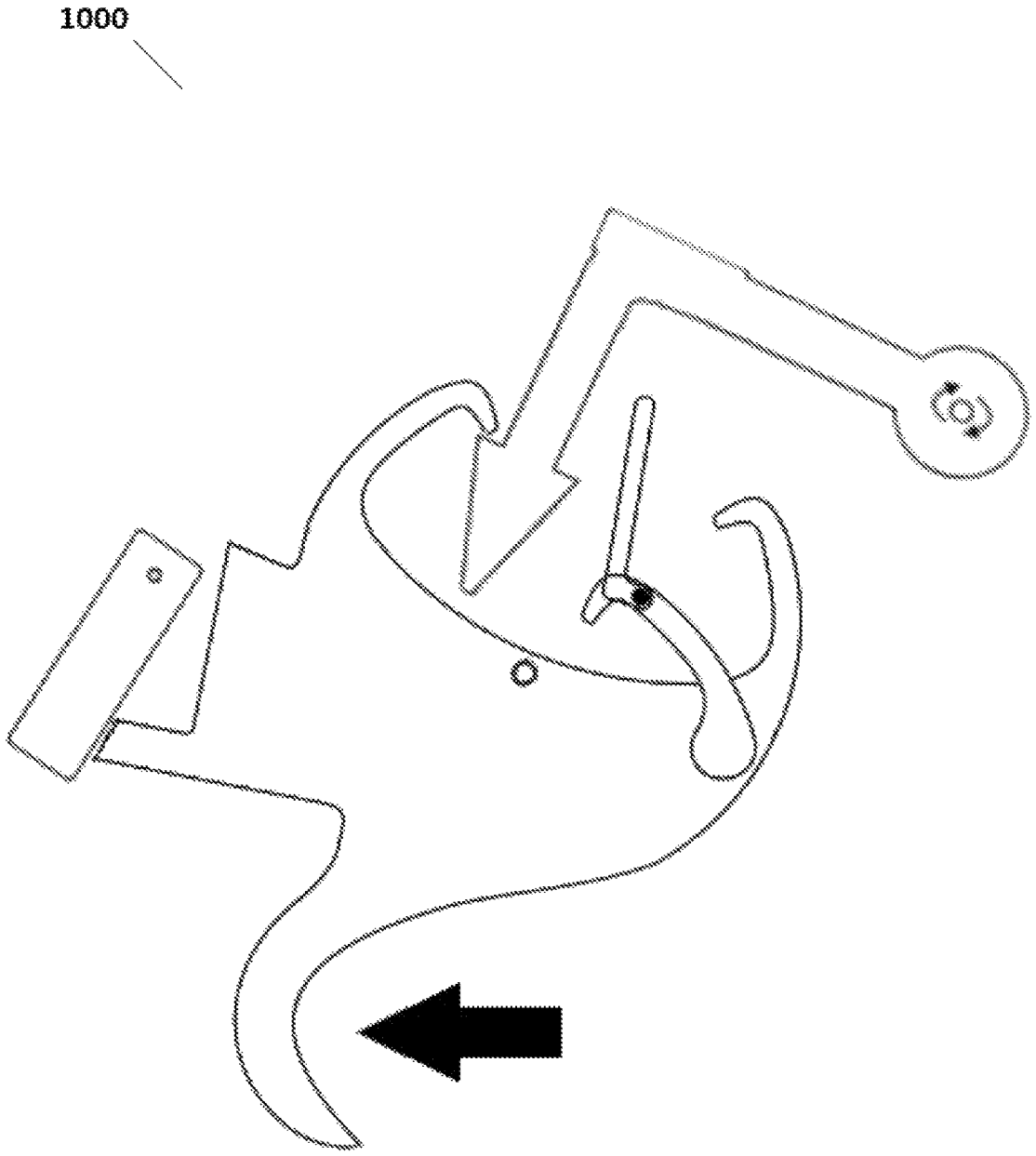
Figure 3H:
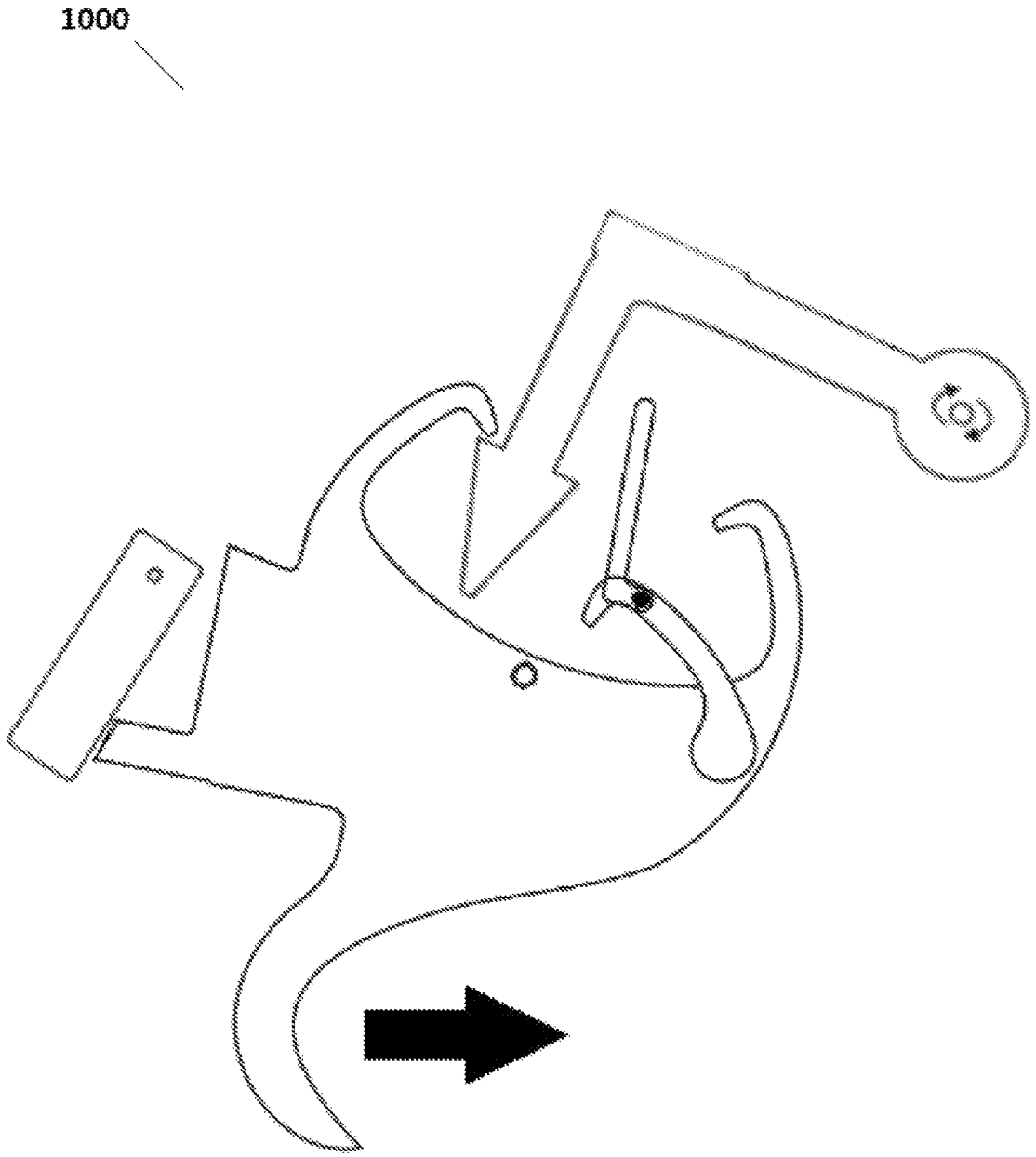
FIGS. 3H through 3N are closer views of the corresponding successive positions H through N of FIG. 3, showing more clearly the example interrelationships of the example components of a trigger, selector, and hammer as installed in an example firearm (not shown) when the selector is positioned in fire-upon-pull-and-release firing mode, allowing still further rearward movement of the trigger to fire the firearm upon pulling the trigger and upon releasing the trigger, depicting successive interaction of the example components in fire-upon-pull-and-release firing mode as the trigger is released from the rearward position and returns to the forward position.
Figure 3I:
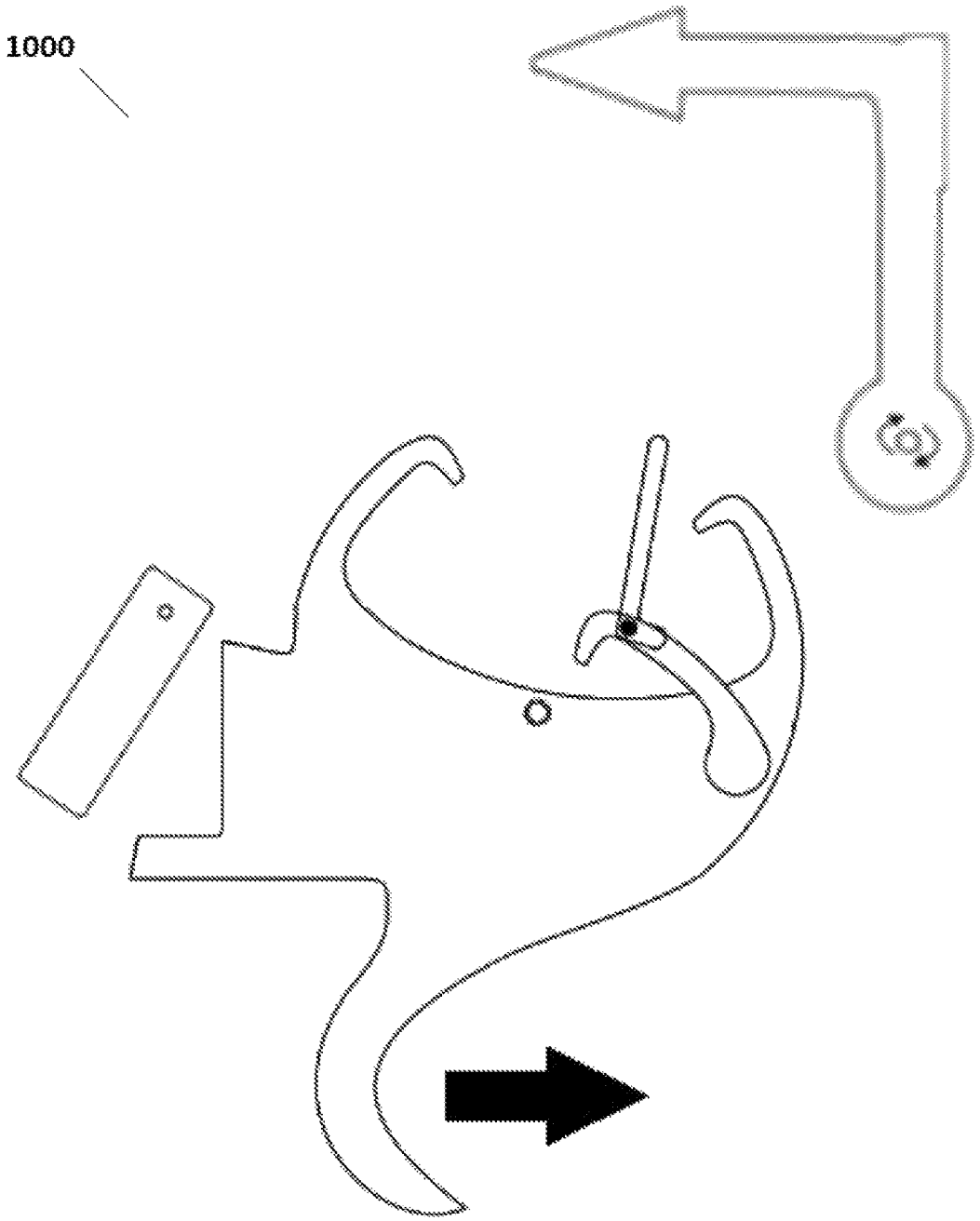
Figure 3J:
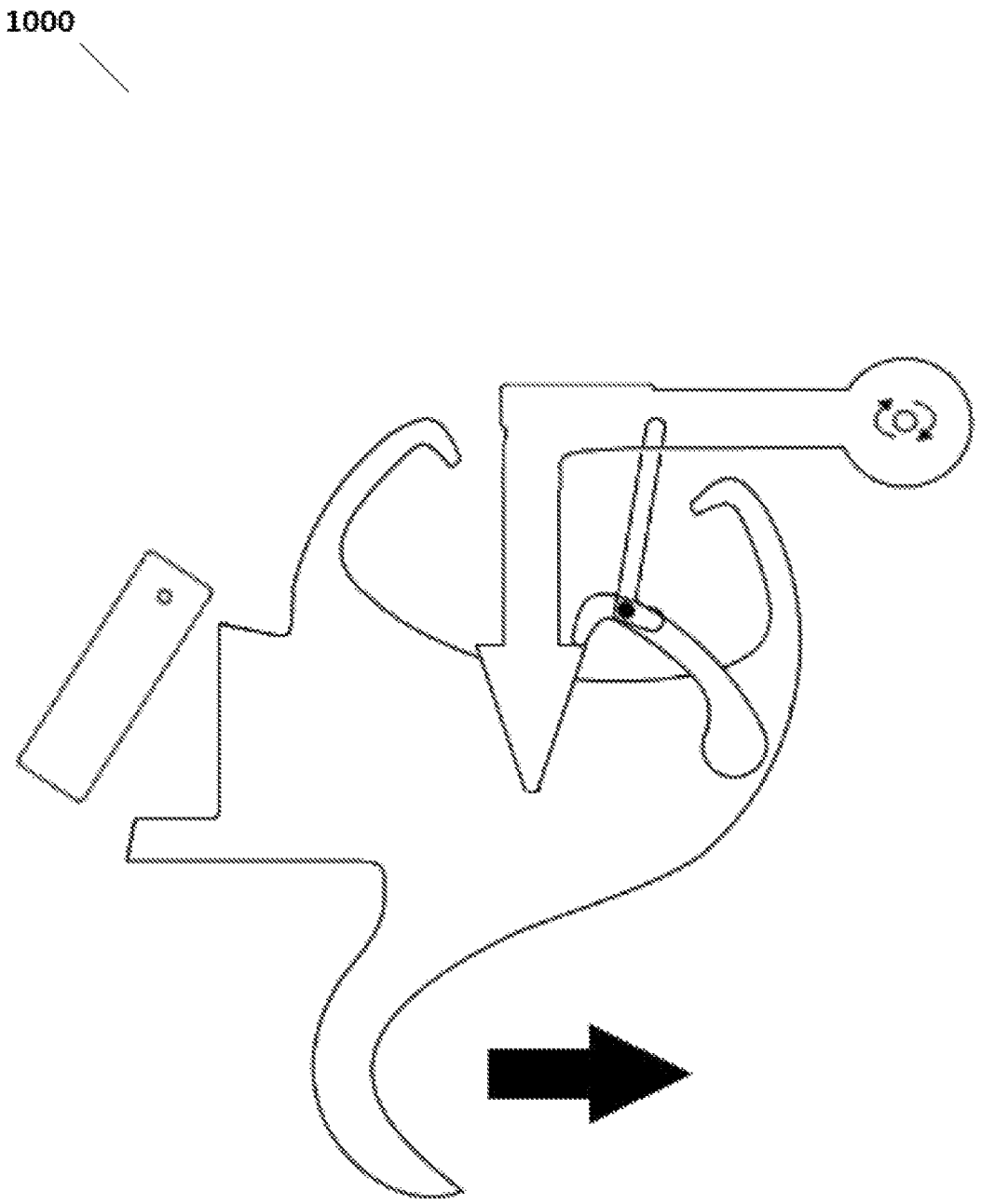
Figure 3K:
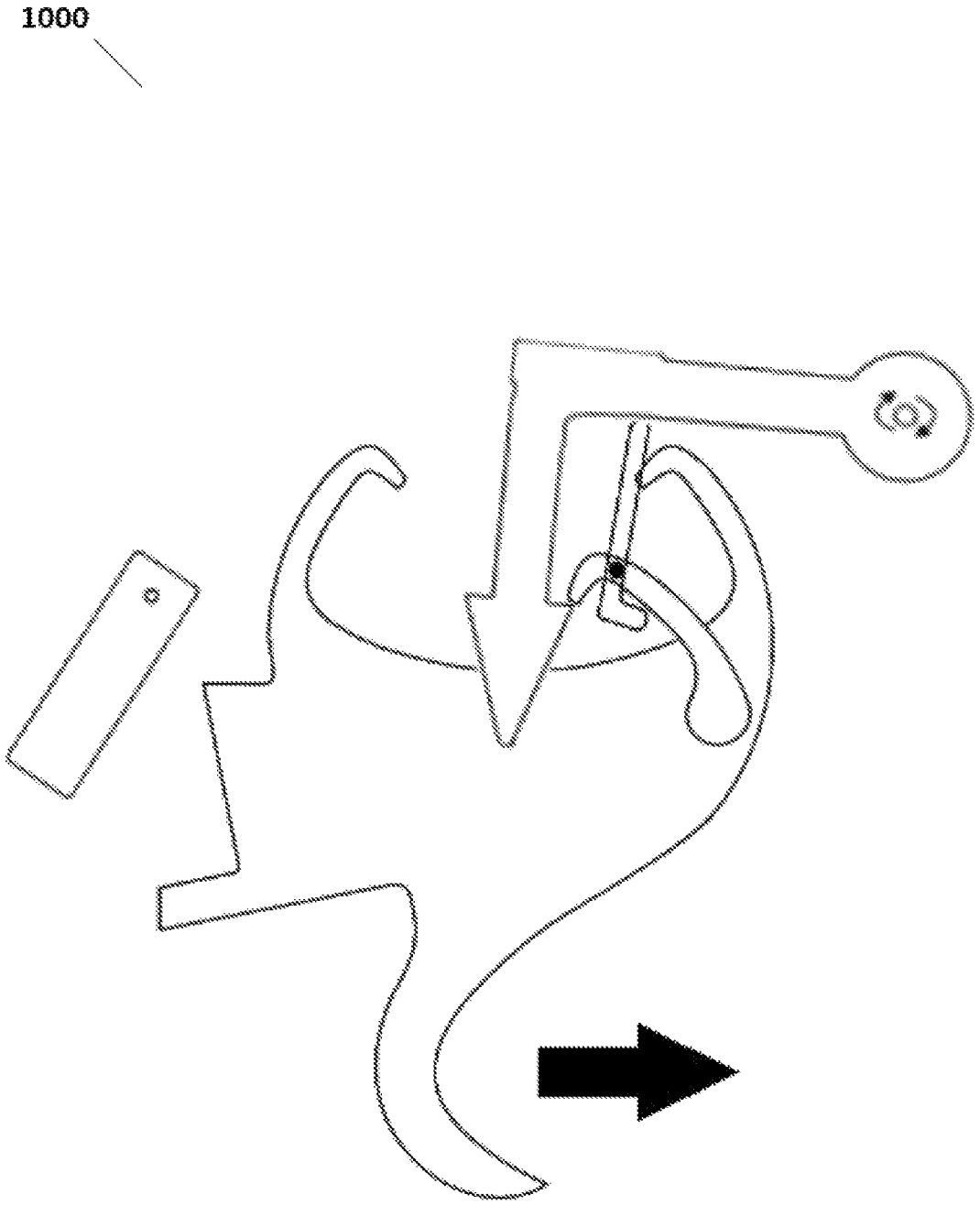
Figure 3L:
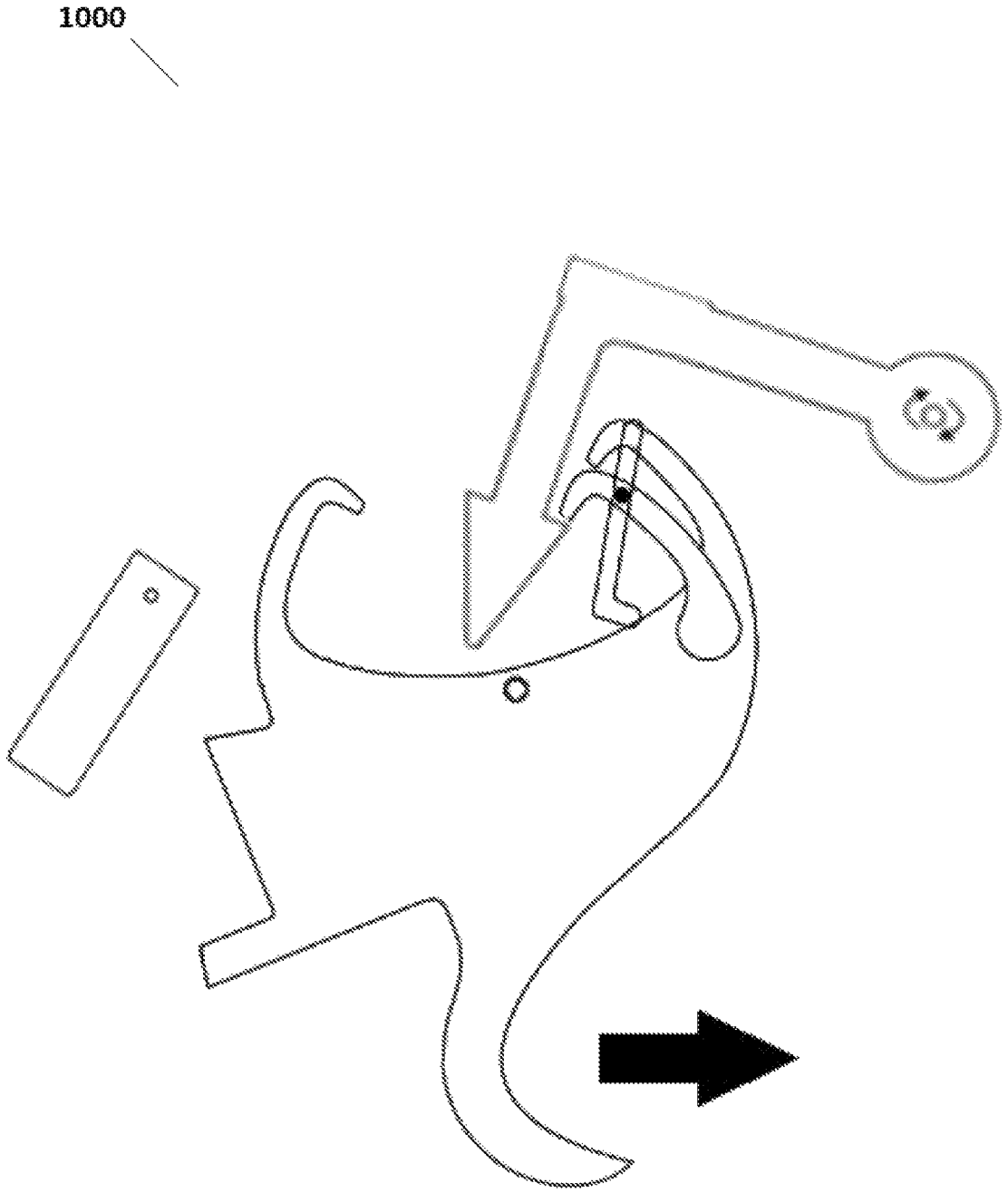
Figure 3M:
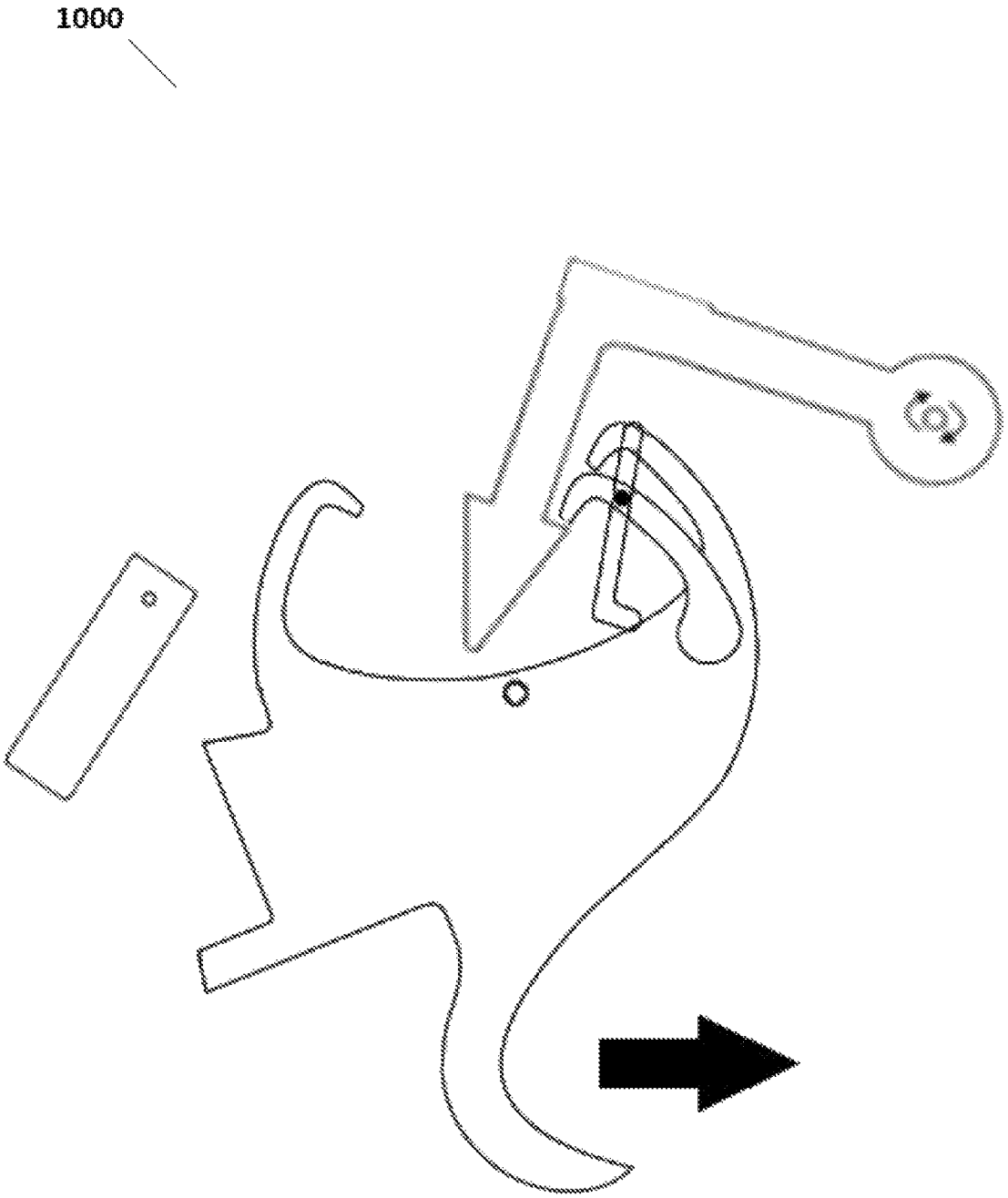
Figure 3N:
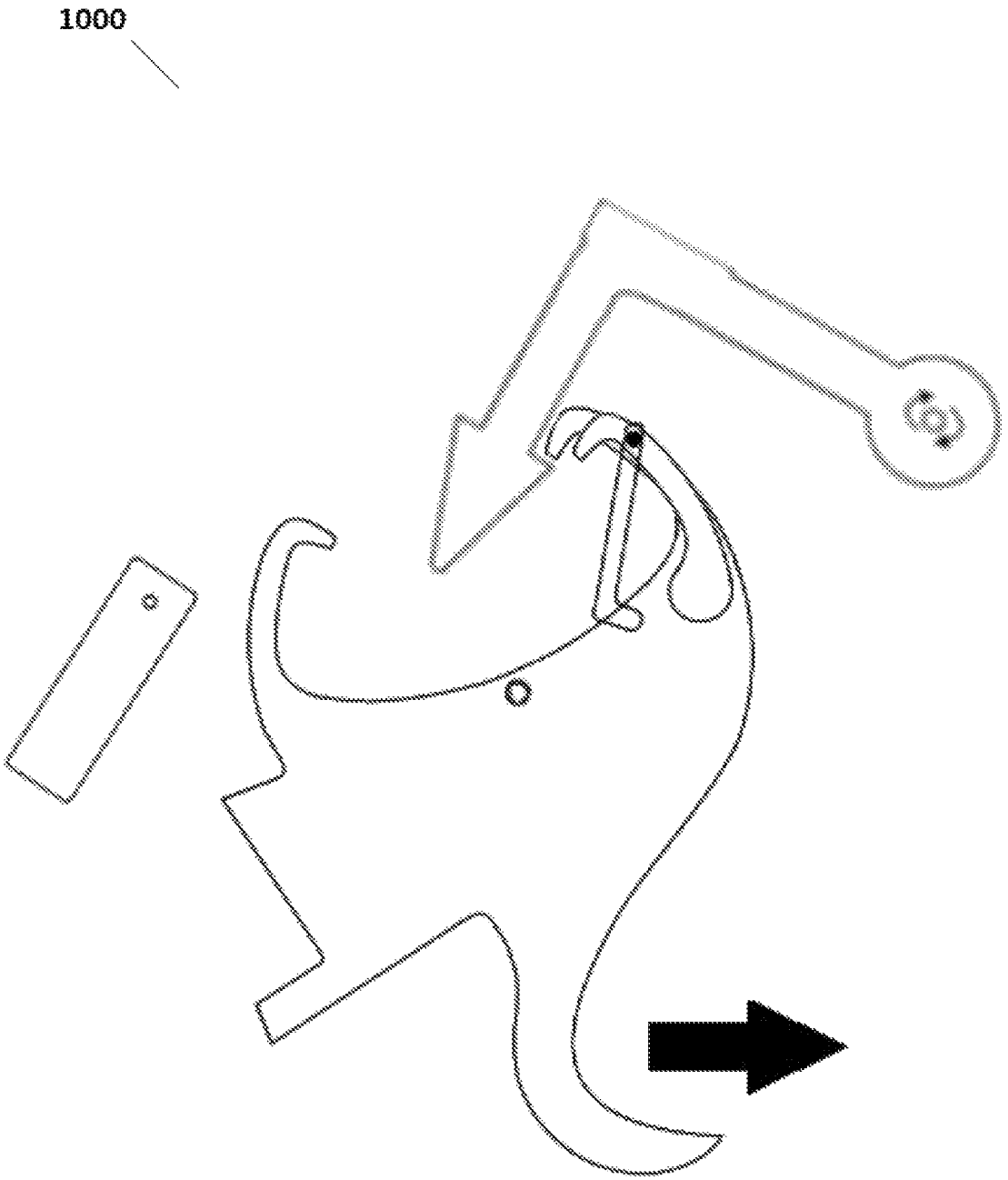

Turning next to FIGS. 3 and 3A through 3N, depicted is an example embodiment where the selector switch 305 is in a second position corresponding to a mode where the firearm fires on both pull and release of the trigger 100 (pull-and-release firing mode), and the selector assembly 300 is configured to restrict movement of the trigger element 105 to a second amount (e.g., the arcuate distance between second selector interface surface 324 of selector assembly 300 and second trigger interface surface 124 as shown in FIG. 3A) when the trigger assembly 1000 is installed in the semi-automatic firearm (not shown) and the selector switch 305 is in the second position (e.g., as shown in FIG. 3A). In pull-and-release firing mode (see generally, FIG. 3), the trigger element 105 may be configured to fire the semi-automatic firearm (not shown) upon the user (not shown) pulling the trigger 100, for instance by applying force to the pulling surface 150 of the trigger 100 and moving the user's finger in the direction 500 shown in FIG. 3A, and thus moving the trigger element 105 from the forward position toward the rearward position (e.g., as shown in FIGS. 3A through 3G), and to also fire the semi-automatic firearm (not shown) upon the user (not shown) releasing the trigger 100, for instance by releasing force from the pulling surface 150 of the trigger 100 and moving the user's finger in the direction 500 shown in FIGS. 3H through 3N, and thus allowing the trigger element 105 that is spring-biased in the forward rotational direction 111 to move from the rearward position toward the forward position (e.g., as shown in FIGS. 3H through 3N), when the trigger assembly 1000 is installed in the semi-automatic firearm (not shown) and the selector switch 305 is in the second position (e.g., as shown in FIG. 3A).

With continuing reference to FIGS. 3 and 3A through 3N, an example embodiment of the trigger assembly 1000 operating in pull-and-release firing mode (where the firearm fires upon the user pulling the trigger 100 and also fires upon the user releasing the trigger 100) will now be described. Beginning at FIG. 3A, the hammer assembly 200 is cocked by rotation of the hammer 205 (for instance by engagement of the hammer 205 with translational movement of the carrier (not shown)) about a hammer pivot 210 against a forward urging force 211 provided by a hammer spring (not shown), for example. The hammer 205 is held in place by engagement of its forward hammer engagement surface 232 with the forward sear engagement surface 132 of the forward sear 128 attached with the trigger 100. As the trigger element 105 begins to move from the forward position (FIG. 3A) toward the rearward position (FIG. 3G), the hammer assembly 200 is released from the cocked position of FIG. 3A to the fired position of FIG. 3B by the rearward rotational movement of the trigger element 105, causing the forward sear engagement surface 132 of the forward sear 128 to move forward and slide off the forward hammer engagement surface 232 of the hammer 205, allowing the hammer 205 to rotate forward about the hammer pivot 210 under the forward urging force 211 and strike the firing pin of the firearm or percussion cap of a cartridge (neither shown), thereby causing the firearm to fire a first round (not shown).

Immediately and almost instantaneously upon firing the first round, the carrier or some other mechanism (not shown) engages the hammer assembly 200 and rotates the hammer 205 rearward about the hammer pivot 210 against the forward urging force 211, moving the forward hammer engagement surface 232 of the hammer 205 back past the forward sear engagement surface 132 of the forward sear 128 and into engagement with disconnect engagement surface 182 of the disconnector 188 as shown in FIG. 3C (reference FIG. 3A for part numbering). While this step is depicted as occurring when the trigger 100 is in the position shown in FIG. 3C, it is understood that this step of re-engaging the hammer 205 with the trigger assembly 1000 can occur regardless of the position of the trigger 100. The disconnector 188 comprises an example disconnector structure 180 that is connected with and pivots about the trigger element 105 at rotation point 181. The role of the disconnector 188 is generally to be in position to capture and retain the hammer 205 as the user is pulling or releasing the trigger 100 during cycling of the firearm, and then to transition the hammer 205 to a sear (e.g., 128, 126) as the trigger 100 moves into position for firing. In order for the disconnector 188 to be in the correct position to capture and retain the hammer 205 as the user is pulling or releasing the trigger 100 during cycling of the firearm, a camming mechanism may be provided to guide the movement of the disconnector 188 as the trigger element 105 rotates about the trigger pivot 110. In the example embodiment shown in the present figures, the camming mechanism comprises a pin 184 attached with the disconnector structure 180, where the pin 184 rides in or is otherwise guided by a slot 400 formed into a housing (not shown) for the trigger assembly 1000, or formed into a similar structure adjacent the trigger assembly 1000. For clarity, only the boundary or edges of the slot 400 are shown in the figures. As depicted in FIGS. 3A through 3G, as the user pulls the trigger 100 from the forward position to the rearward position, the disconnector structure 180 pivots about the rotation point 181 and moves the disconnector 188 through a path underneath and rearward of forward sear 128 by the pin 184 moving within the slot 400 from an upper slot portion 402, rearward and downward toward a lower slot portion 404.

In the rearward-most position of the trigger 100 in pull-and-release firing mode (FIG. 3G), the second selector interface 324 of the selector assembly 300 contacts the second trigger interface surface 124 of the trigger 100, stopping further rearward movement of the trigger 100. Alternatively, in an embodiment not shown but understood from the following description, in the rearward-most position of the trigger 100 in pull-and-release firing mode (FIG. 3G), the selector assembly 300 may move entirely out of the way of the trigger assembly 1000, allowing the trigger to contact some other structure (not shown) that stops further rearward movement of the trigger 100.

As the trigger element 105 rotates further back than was possible in semi-automatic firing mode (compare, FIG. 2), the trigger element 105 pivots about trigger pivot 110 from the position shown in FIG. 3F to the position shown in FIG. 3G (which is the same as the position shown in FIG. 3H), and the disconnector structure 180 pivots about the rotation point 181 and moves the disconnector 188 through a path underneath and forward of rearward sear 126 by the pin 184 moving within the slot 400 forward and downward into lower slot portion 404, causing the disconnector engagement surface 182 of the disconnector 188 to slide off the forward hammer engagement surface 232 of the hammer 205, and the hammer 205 is handed-off or otherwise transferred from the disconnector 188 to the rearward sear 126, by allowing the rearward hammer engagement surface 230 of the hammer 205 to jump up, under the forward urging force 211 on the hammer 205, to the rearward engagement surface 130 on the rearward sear 126. Then the trigger element 105 is in the position shown in FIG. 3G, which is the same position shown in FIG. 3H, and the firearm is ready to be fired again, for the second time during the cycle, upon releasing the trigger 100 from the rearward position as shown in the transition from FIG. 3H to FIG. 3I.

As the trigger element 105 begins to move from the rearward position (FIG. 3H) toward the more forward position (FIG. 3I), the hammer assembly 200 is released from the cocked position of FIG. 3H to the fired position of FIG. 3I by the forward rotational movement of the trigger element 105 causing the rearward sear engagement surface 130 of the rearward sear 126 to move rearward and slide off the rearward hammer engagement surface 230 of the hammer 205, allowing the hammer 205 to rotate forward about the hammer pivot 210 under the forward urging force 211 and strike the firing pin of the firearm or percussion cap of a cartridge (neither shown), thereby causing the firearm to fire a round again, for the second time during the cycle.

Immediately and almost instantaneously upon firing the second round, the carrier or some other mechanism (not shown) engages the hammer assembly 200 and rotates the hammer 205 rearward about the hammer pivot 210 against the forward urging force 211, moving the forward hammer engagement surface 232 of the hammer 205 back past the forward sear engagement surface 132 of the forward sear 128 and into engagement with disconnect engagement surface 182 of the disconnector 188 as shown in FIG. 3J (reference FIG. 3A for part numbering). While this step is depicted as occurring when the trigger 100 is in the position shown in FIG. 3J, it is understood that this step of re-engaging the hammer 205 with the trigger assembly 1000 can occur regardless of the position of the trigger 100. As depicted in FIGS. 3J through 3M, as the user releases the trigger 100 from the rearward position to the forward position, the disconnector structure 180 pivots about the rotation point 181 and moves the disconnector 188 through a path underneath and rearward of forward sear 128 by the pin 184 moving within the slot 400 from a lower slot portion 404, forward and upward toward an upper slot portion 402.

As illustrated in FIG. 3, in FIG. 3M the trigger element 105 is in the same position as in FIG. 3B. But in FIG. 3B the hammer 105 was released and the firearm was fired, while in FIG. 3M the hammer was retained and the firearm was not fired. Likewise, in FIG. 3F the trigger element 105 is in the same position as in FIG. 3I. But in FIG. 3I the hammer 105 was released and the firearm was fired, while in FIG. 3F the hammer was retained and the firearm was not fired. This is because, due to the order of operations of the disclosed trigger assembly 1000, in FIGS. 3M and 3F the hammer 205 is being retained by the disconnector 188, while in FIGS. 3B and 3I the hammer 205 is not being retainer by the disconnector 188. The order of operations explaining the difference between FIGS. 3F and 3I was described above with respect to handing-off or otherwise transferring the hammer 205 from the disconnector 188 to the rearward sear 126 in FIG. 3G. Regarding the difference between FIGS. 3B and 3M, the trigger element 105 pivots about trigger pivot 110 from the position shown in FIG. 3M to the position shown in FIG. 3N (which is the same as the position shown in FIG. 3A), the forward hammer engagement surface 232 of the hammer 205 is handed-off or otherwise transferred from the disconnector engagement surface 182 on the disconnector 188 to the forward sear engagement surface 132 on the forward sear 128, by the disconnector engagement surface 182 of the disconnector 188 sliding off the forward hammer engagement surface 232 of the hammer 205, allowing the forward hammer engagement surface 232 of the hammer 205 to jump up, under the forward urging force 211 on the hammer 205, to the forward sear engagement surface 132 on the forward sear 128. Then the trigger element 105 is in the position shown in FIG. 3N, which is the same position shown in FIG. 3A, and the firearm is ready to be fired again upon pulling the trigger 100 as shown in FIG. 3B, and the cycle repeats, having fired twice in one cycle, which is pull-and-release firing mode.

Turning to FIG. 1, depicted is an example embodiment where the selector switch 305 is in a safety position corresponding to an optional safe mode that prevents firing of the firearm (not shown), and the selector assembly 300 is configured to restrict movement of the trigger element 105 to a third amount (e.g., the arcuate distance between first selector interface surface 320 of selector assembly 300 and third trigger interface surface 120 as shown in FIG. 1) less than the first amount (e.g., the arcuate distance between first selector interface surface 320 of selector assembly 300 and first trigger interface surface 122 as shown in FIG. 2A) and less than the second amount (e.g., the arcuate distance between second selector interface surface 324 of) when the trigger assembly 1000 is installed in the semi-automatic firearm (not shown) and the selector switch 305 is in the third position (depicted in FIG. 1). In various example embodiments the third amount of movement of the trigger (e.g., the arcuate distance between first selector interface surface 320 of selector assembly 300 and third trigger interface surface 120 as shown in FIG. 1) may be nothing, i.e., no distance, and no movement of the trigger (or no rearward movement of the trigger). Accordingly, in various example embodiments the trigger assembly 1000 is configured to prevent firing of the semi-automatic firearm (now shown) by restricting movement of the trigger element 105 to the third amount (e.g., the arcuate distance between first selector interface surface 320 of selector assembly 300 and third trigger interface surface 120 as shown in FIG. 1) when the trigger assembly 1000 is installed in the semi-automatic firearm (not shown) and the selector switch 305 is in the third position shown in FIG. 1.

While the rearward sear 126, forward sear 128, and disconnector 188 are shown in the figures as being rigidly affixed with their respective supporting structures (i.e., rearward sear support structure 160, forward sear support structure 170, and disconnector structure 180), it is understood that this rigid structure is shown for simplicity and clarity, and that in practice the sears and disconnector(s) may be pivotably attached with their respective supporting structures, either directly or through other kinematic structural elements which may including additional members, cams, and other structures. Such pivotable attachment means may be employed to facilitate the hammer 205 engaging the sears and disconnector(s) when a rear hammer surface 220 or a front hammer surface 222 contacts and slides past the rearward sear 126, forward sear 128, or the disconnector 188, when the hammer 205 is returned to the trigger assembly 1000 after firing the firearm (not shown).

Figure 2J:
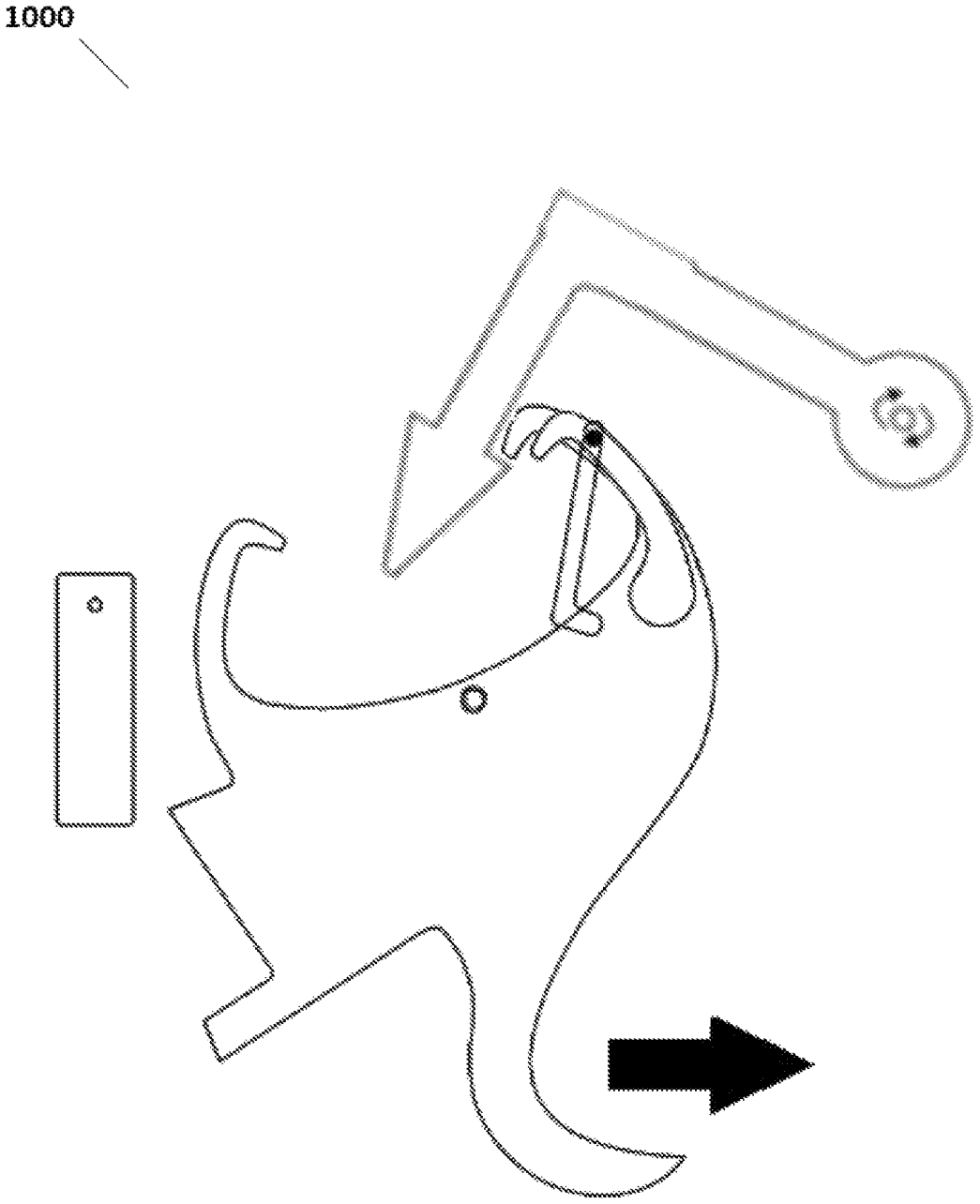

Also provided in various example embodiments is a method of selecting between firing modes of a semi-automatic firearm, comprising the steps of: providing a semi-automatic firearm as described herein; moving the selector switch 305 to the first position (e.g., FIG. 2) and causing the semi-automatic firearm to restrict movement of the trigger 100 to the first amount (e.g., the arcuate distance between first selector interface surface 320 of selector assembly 300 and first trigger interface surface 122 as shown in FIG. 2A); and firing the semi-automatic firearm by pulling the trigger 100 from the forward position (e.g., as shown in FIGS. 2A, 2J) toward the rearward position (e.g., as shown in FIGS. 2E, 2F). In various example embodiments the method may further comprise the steps of: moving the selector switch to the second position (e.g., FIG. 3) and causing the semi-automatic firearm to restrict movement of the trigger 100 to the second amount (e.g., the arcuate distance between second selector interface surface 324 of selector assembly 300 and second trigger interface surface 124 as shown in FIG. 3A); firing the semi-automatic firearm by pulling the trigger 100 from the forward position (e.g., as shown in FIGS. 3A, 3M) toward the rearward position (e.g., as shown in FIGS. 3G, 3H); and firing the semi-automatic firearm by releasing the trigger 100 from the rearward position (e.g., as shown in the transition between FIGS. 3H to 3I). In various example embodiments the method may further comprise the step of causing the semi-automatic firearm to restrict movement of the trigger to the second amount (e.g., the arcuate distance between second selector interface surface 324 of selector assembly 300 and second trigger interface surface 124 as shown in FIG. 3A) such that the second amount is more than the first amount (e.g., the arcuate distance between first selector interface surface 320 of selector assembly 300 and first trigger interface surface 122 as shown in FIG. 2A). In various example embodiments the method may further comprise the steps of: moving the selector switch 305 to the third position (e.g., as shown in FIG. 1) and causing the semiautomatic firearm to restrict movement of the trigger 100 to the third amount (e.g., the arcuate distance between first selector interface surface 320 of selector assembly 300 and third trigger interface surface 120 as shown in FIG. 1). In various example embodiments the method may further comprise the step of causing the semi-automatic firearm to restrict movement of the trigger 100 to the second amount such that the second amount is more than the first amount. In various example embodiments the method may further comprise the step of causing the semi-automatic firearm to restrict movement of the trigger 100 to the third amount such that the third amount is no movement, i.e., insufficient rearward movement to fire the firearm.

While a complete firearm is not shown in the present figures, example components are shown in example positions and orientations as they could appear in a firearm, and it is intended that the invention includes complete firearms incorporating the structures and functionalities described herein, such as, for example, otherwise conventional AR and AK type semi-automatic firearms incorporating structures having features and/or functionalities as described herein. Accordingly, provided in various example embodiments is a semi-automatic firearm comprising a trigger assembly 1000 and a selector assembly 300 with the features and functionalities described herein.

Further provided in various example embodiments is a kit, comprising: a trigger assembly 1000 as described herein, having a trigger element 105 and configured to be installed in a semi-automatic firearm; and a selector assembly 300 configured to be installed in the semi-automatic firearm and to work in conjunction with the trigger assembly 1000 when installed in the semi-automatic firearm to provide the firearm with the features and functionalities described herein.

It is understood that the above-described embodiments are merely illustrative of the application. Other embodiments may be readily devised by those skilled in the art, which may embody one or more aspects or principles of the invention and fall within the scope of the claims. Any suitable materials and manufacturing methods may be used as would be apparent to persons of skill in the art.

What is claimed is:

1. A semi-automatic firearm, comprising:

a hammer;

a trigger configured to be movable from a forward position toward a rearward position by a user pulling the trigger from the forward position toward the rearward position, and configured to be movable from the rearward position toward the forward position by the user releasing the trigger from the rearward position;

a rearward sear support structure, forward sear support structure, and disconnector structure, all configured to collectively engage and restrain the hammer throughout movement of the trigger between the rearward and forward positions, except when the trigger, rearward sear support structure, forward sear support structure, and disconnector structure, have all been moved into predetermined positions configured to release the hammer and fire the semi-automatic firearm a single time;

a selector switch configured to be movable by the user between at least a first position and a second position;

the semi-automatic firearm configured to, when the selector switch is in the first position:

restrict movement of the trigger to a first range of motion;

fire upon the user pulling the trigger from the forward position toward the rearward position; and not fire upon the user releasing the trigger from the rearward position;

the semi-automatic firearm configured to, when the selector switch is in the second position:

restrict movement of the trigger to a second range of motion greater than the first range of motion;

fire upon the user pulling the trigger from the forward position toward the rearward position; and fire upon the user releasing the trigger from the rearward position;

wherein the selector switch is configured to directly engage the trigger to restrict movement of the trigger to the first range of motion when the selector switch is in the first position.

2. The semi-automatic firearm of claim 1, further comprising the selector switch configured to be movable by the user between at least the first position, the second position, and a third position, the semi-automatic firearm configured to, when the selector switch is in the third position:

restrict movement of the trigger to a third range of motion less than the first range of motion and less than the second range of motion; and prevent the semi-automatic firearm from firing.

3. The semi-automatic firearm of claim 2, further comprising the third range of motion being no movement of the trigger.

4. The semi-automatic firearm of claim 1, wherein the disconnector structure is configured to move relative to the hammer in a path guided by a camming mechanism.

5. The semi-automatic firearm of claim 4, wherein the camming mechanism comprises a pin movable within a slot.

6. The semi-automatic firearm of claim 5, wherein a first portion of the slot extends in a first direction and a second portion of the slot extends in a second direction different than the first direction.

7. A method of selecting between firing modes of a semi-automatic firearm, comprising the steps of:

providing the semi-automatic firearm of claim 1;

moving the selector switch to the first position and causing the semi-automatic firearm to restrict movement of the trigger to the first range of motion; and firing the semi-automatic firearm by pulling the trigger from the forward position toward the rearward position.

8. The method of claim 7, further comprising the steps of:

moving the selector switch to the second position and causing the semi-automatic firearm to restrict movement of the trigger to the second range of motion;

firing the semi-automatic firearm by pulling the trigger from the forward position toward the rearward position; and firing the semi-automatic firearm by releasing the trigger from the rearward position.

9. A method of selecting between firing modes of a semi-automatic firearm, comprising the steps of:

providing the semi-automatic firearm of claim 1;

moving the selector switch to the first position and causing the semi-automatic firearm to restrict movement of the trigger to the first range of motion, and firing the semi-automatic firearm by pulling the trigger from the forward position toward the rearward position;

moving the selector switch to the second position and causing the semi-automatic firearm to restrict movement of the trigger to the second range of motion, and firing the semi-automatic firearm by pulling the trigger from the forward position toward the rearward position, and firing the semi-automatic firearm by releasing the trigger from the rearward position; and moving the selector switch to the third position and causing the semi-automatic firearm to restrict movement of the trigger to the third range of motion.

10. The method of claim 9, further comprising the step of causing the semi-automatic firearm to restrict movement of the trigger to the third range of motion such that the third range of motion is no movement.

11. A trigger assembly having a trigger element and configured to be installed in a semi-automatic firearm having a hammer and a selector assembly configured to be movable by a user moving a selector switch between at least a first position and a second position, wherein the selector assembly is configured to restrict movement of the trigger element to a first range of motion when the trigger assembly is installed in the semi-automatic firearm and the selector switch is in the first position, and to restrict movement of the trigger element to a second range of motion greater than the first range of motion when the trigger assembly is installed in the semi-automatic firearm and the selector switch is in the second position;

the trigger element configured to be movable from a forward position toward a rearward position by a user pulling the trigger element from the forward position toward the rearward position, the trigger element configured to be movable from the rearward position toward the forward position by the user releasing the trigger element from the rearward position;

the trigger assembly configured to fire the semi-automatic firearm upon the user pulling the trigger from the forward position toward the rearward position, and not fire the semi-automatic firearm upon the user releasing the trigger from the rearward position, when the trigger assembly is installed in the semi-automatic firearm and the selector switch is in the first position;

the trigger assembly configured to fire the semi-automatic firearm upon the user pulling the trigger from the forward position toward the rearward position, and to fire the semi-automatic firearm upon the user releasing the trigger from the rearward position, when the trigger assembly is installed in the semi-automatic firearm and the selector switch is in the second position;

the trigger assembly comprising a rearward sear support structure, forward sear support structure, and disconnector structure, all configured to collectively engage and restrain the hammer throughout movement of the trigger between the rearward and forward positions, except when the trigger, rearward sear support structure, forward sear support structure, and disconnector structure, have all been moved into predetermined positions configured to release the hammer and fire the semi-automatic firearm a single time;

wherein the selector switch is configured to directly engage the trigger element to restrict movement of the trigger element to the first range of motion when the selector switch is in the first position.

12. The trigger assembly of claim 11, further comprising:

the trigger assembly is configured to be installed in a semi-automatic firearm having a selector assembly configured to be movable by the user moving the selector switch between at least the first position, the second position, and a third position, wherein the selector assembly is configured to restrict movement of the trigger element to a third range of motion less than the first range of motion and less than the second range of motion when the trigger assembly is installed in the semi-automatic firearm and the selector switch is in the third position; and the trigger assembly is configured to prevent firing of the semi-automatic firearm by restricting movement of the trigger element to the third range of motion when the trigger assembly is installed in the semi-automatic firearm and the selector switch is in the third position.

13. The trigger assembly of claim 12, further comprising the third range of motion being no movement of the trigger.

14. A kit, comprising:

a trigger assembly according to claim 11, having a trigger element and configured to be installed in a semi-automatic firearm; and a selector assembly configured to be installed in the semi-automatic firearm and to work in conjunction with the trigger assembly when installed in the semi-automatic firearm to:

be movable by a user moving a selector switch between at least a first position and a second position;

to restrict movement of the trigger element to a first range of motion when the trigger assembly is installed in the semi-automatic firearm and the selector switch is in the first position; and to restrict movement of the trigger element to a second range of motion greater than the first range of motion when the trigger assembly is installed in the semi-automatic firearm and the selector switch is in the second position.

15. The kit of claim 14, further comprising the selector assembly configured to be movable by the user moving the selector switch between at least the first position, the second position, and a third position;

the selector assembly configured to restrict movement of the trigger element to a third range of motion less than the first range of motion and less than the second range of motion when the trigger assembly and the selector assembly are installed in the semi-automatic firearm and the selector switch is in the third position; and the trigger assembly configured to prevent firing of the semi-automatic firearm by restricting movement of the trigger element to the third range of motion when the trigger assembly and the selector assembly are installed in the semi-automatic firearm and the selector switch is in the third position.

* * * * *